US009835395B2

(12) United States Patent
Ruby et al.

(10) Patent No.: US 9,835,395 B2
(45) Date of Patent: Dec. 5, 2017

(54) APPARATUS AND METHOD FOR RELOADING FIREARM MAGAZINES

(71) Applicant: Firearm Technologies LLC, Malvern, PA (US)

(72) Inventors: Brian Price Ruby, Columbus, MS (US); Ryan Koonz, Norfolk, VA (US); Stephen Michael Ian Kunen, Jersey City, NJ (US)

(73) Assignee: Firearm Technologies LLC, St. Petersburg, FL (US)

( * ) Notice: Subject to any disclaimer, the term of this patent is extended or adjusted under 35 U.S.C. 154(b) by 0 days.

(21) Appl. No.: 14/728,814

(22) Filed: Jun. 2, 2015

(65) Prior Publication Data

US 2015/0267980 A1 Sep. 24, 2015

Related U.S. Application Data

(63) Continuation of application No. 14/177,353, filed on Feb. 11, 2014, now Pat. No. 9,175,923.

(60) Provisional application No. 61/762,973, filed on Feb. 11, 2013, provisional application No. 61/893,861, filed on Oct. 21, 2013.

(51) Int. Cl.

| | |
|---|---|
| ***F41A 9/64*** | (2006.01) |
| ***F41A 9/38*** | (2006.01) |
| ***F41C 27/00*** | (2006.01) |
| ***F41A 9/68*** | (2006.01) |

(52) U.S. Cl.

CPC *F41A 9/38* (2013.01); *F41A 9/64* (2013.01); *F41A 9/68* (2013.01); *F41C 27/00* (2013.01)

(58) Field of Classification Search

CPC .. F41C 27/00; F41C 23/16; F41A 9/00; F41A 9/64; F41A 9/61

USPC ..... 42/49.01, 49.02, 50, 90, 106; 89/34, 1.1, 89/1.4, 45

See application file for complete search history.

(56) References Cited

U.S. PATENT DOCUMENTS

| | | | | |
|---|---|---|---|---|
| 1,526,847 A | | 2/1925 | Fritz | |
| 2,004,925 A | * | 6/1935 | Carrillo | F41A 3/22 89/13.05 |
| 2,147,208 A | * | 2/1939 | Nolan | F41A 9/68 42/49.01 |
| 2,231,978 A | | 2/1941 | Wesson | |

(Continued)

FOREIGN PATENT DOCUMENTS

| | | |
|---|---|---|
| DE | 3 016 54 C | 4/1920 |
| EP | 415054 A | 3/1991 |

OTHER PUBLICATIONS

Defense Procurement Manufacturing Services, Inc. (DPMS) May 22, 2002, DPMS website http://www.dpmsinc.com, Triple Mag Holder.

(Continued)

*Primary Examiner* — Jonathan C Weber

(74) *Attorney, Agent, or Firm* — Stetina Brunda Garred & Brucker

(57) ABSTRACT

An automatic or semi-automatic magazine reloading firearm is described that includes a magazine track that stores one or more reserve magazines. After ejecting an active magazine from the active magazine well, a reload arrangement can be activated to move a reserve magazine from the magazine track into the active magazine well and lock it into place to allow for continued firing, increased safety, and positive user control.

26 Claims, 22 Drawing Sheets

(56) References Cited

U.S. PATENT DOCUMENTS

| | | | | | |
|---|---|---|---|---|---|
| 3,045,553 | A * | 7/1962 | Mosle | F41A 9/76 | 42/50 |
| 3,623,256 | A * | 11/1971 | Shiplee, III | F41A 9/63 | 42/50 |
| 4,100,694 | A | 7/1978 | Musgrave | | |
| 4,115,943 | A * | 9/1978 | Musgrave | F42B 39/02 | 42/71.01 |
| 4,166,333 | A | 9/1979 | Kratzer | | |
| 4,447,976 | A | 5/1984 | Cooper | | |
| 4,484,403 | A | 11/1984 | Schwaller | | |
| 4,484,404 | A | 11/1984 | Johnson | | |
| 4,628,627 | A | 12/1986 | Johnson | | |
| 4,685,238 | A | 8/1987 | Schoepflin | | |
| 4,685,600 | A | 8/1987 | Reuschel | | |
| 5,279,059 | A | 1/1994 | Howard | | |
| 5,636,465 | A | 6/1997 | Johnson | | |
| 5,676,241 | A | 10/1997 | Degoix et al. | | |
| 6,000,589 | A | 12/1999 | Burdine | | |
| 6,668,479 | B1 | 12/2003 | Obong | | |
| 6,698,129 | B1 | 3/2004 | Hanks | | |
| 6,796,074 | B1 | 9/2004 | Obong | | |
| 6,829,855 | B2 | 12/2004 | Seifert | | |
| D502,524 | S | 3/2005 | Shiloni et al. | | |
| 7,073,285 | B2 | 7/2006 | Obong | | |
| D588,227 | S | 3/2009 | Swenson et al. | | |
| 7,497,043 | B2 | 3/2009 | Clifton, Jr. et al. | | |
| 7,562,482 | B1 | 7/2009 | Johnson | | |
| 7,805,875 | B1 | 10/2010 | Obong | | |
| 7,810,271 | B2 | 10/2010 | Patel | | |
| 7,975,420 | B2 | 7/2011 | Pestana | | |
| 8,336,442 | B2 * | 12/2012 | Testa | F41A 7/08 | 89/45 |
| D689,581 | S | 9/2013 | Fitzpatrick et al. | | |
| 8,640,374 | B1 | 2/2014 | Reichelt | | |
| 8,739,451 | B2 | 6/2014 | Nelson | | |
| 2006/0242877 | A1 | 11/2006 | Clifton et al. | | |
| 2010/0263255 | A1 | 10/2010 | Harris | | |
| 2012/0152103 | A1 * | 6/2012 | Testa | F41A 7/08 | 89/129.01 |
| 2012/0311911 | A1 | 12/2012 | Nelson | | |
| 2014/0223791 | A1 | 8/2014 | Ruby et al. | | |

OTHER PUBLICATIONS

Defense Procurement Manufacturing Services, Inc. (DPMS) May 22, 2002, www.shooterstore.com/acb/showdetl.cfm?&DID=90Product_I 0=6411 &CATI 0=494 Side-by-Side A-15 Magazine Holder.

Defense Procurement Manufacturing Services, Inc. (DPMS) May 22, 2002 www.shooterstore.com/acb/showdetl.clm?&DID=90Product_1D=6398&CATID=494 Johnson REDI-MAG Model RM w/Jam Button.

Buffer Technologies May 22, 2002,http://www.buffertech.com/magcinch Mag Cinch.

* cited by examiner

APPARATUS AND METHOD FOR RELOADING FIREARM MAGAZINES

CROSS REFERENCE TO RELATED APPLICATIONS

This application is a continuation and claims the benefit of U.S. patent application Ser. No. 14/177,353, filed on Feb. 11, 2014, entitled "APPARATUS AND METHOD FOR RELOADING FIREARM MAGAZINES," which claims the benefit of United States Provisional Patent Application No. 61/762,973 filed on Feb. 11, 2013, entitled "APPARATUS AND METHOD FOR MECHANICALLY INTERCHANGING FIREARM MAGAZINES FACILITATING POSITIVE USER CONTROL," and U.S. Provisional Patent Application No. 61/893,861 filed on Oct. 21, 2013, the disclosures of which are incorporated herein by reference in their entireties.

FIELD OF THE PRESENT INVENTION

The present invention relates generally to the field of firearms, specifically to a firearm that is configured to provide the storage and automatic or semi-automatic reloading of one or more spare magazines after an active magazine is removed or ejected from the firearm.

BACKGROUND INFORMATION

Many modern firearms used for combat or sporting activities are equipped with magazines capable of holding a plurality of cartridges. Such magazines can facilitate and simplify loading of individual cartridges into a firing chamber. A magazine is typically released manually from the firearm before another magazine with additional cartridges can be inserted into the firearm, e.g., to continue firing. For example, as described in U.S. Pat. No. 5,676,241 issued to Christophe Degoix et al., reloading a magazine-adapted firearm typically involves pressing a magazine release button on the side of a magazine well of the firearm to release the magazine, pulling the magazine clear of the magazine well, storing it for later reuse, grasping a new magazine with cartridges in it, inserting the new magazine into the magazine well until it clicks into place, and then chambering a cartridge from the new magazine.

Typically, spare magazines may be carried in a protective pouch attached to a user's belt or carried in the user's pocket or the like. Certain firearms may also be configured to carry one or more spare magazines affixed to other parts of the firearm for convenience. However, the removal and insertion of additional magazines may present safety concerns for the user. For example, during reloading in a combat situation, a soldier or law enforcement official may be exposed to enemy fire and unable to continue firing until the reloading process is completed. As another example, an accidental discharge of the firearm may occur during a botched reloading procedure, e.g. with magazine-fed firearms. A prolonged period for reloading magazines can also affect, e.g., the overall firing speed of competitive skeet shooters.

Various systems have been developed to expedite and ease the carrying and/or reloading of additional magazines into a firearm. For example, multiple magazine holders can couple together two or more magazines so that a combatant or sportsman will have more than one magazine readily available for use with the weapon. Such holders can include, for example, magazines that are welded or otherwise affixed together. For example, a clip joining device for holding two clips end to end is described, e.g., in U.S. Pat. No. 4,685,238 issued to Schoepflin, a box-like protective device attachable to the weapon is described, e.g., in U.S. Pat. No. 4,484,404 issued to Johnson, and magazine doublers that are formed as a dual magazine holder to provide users the ability to quickly and efficiently reload rifles with a second magazine are described, e.g., in U.S. Pat. No. 7,497,043 issued to Clifton, Jr. et al. None of these references describe a firearm system that provides the ability to store and automatically or semi-automatically introduce spare magazines into the active magazine well of a weapon.

Accordingly, there is a need for a firearm capable of storing one or more spare firearm magazines that further facilitates the automatic or semi-automatic exchange of magazines into the active magazine well of the firearm upon the partial or full exhaustion of cartridges from the active magazine.

SUMMARY OF EXEMPLARY EMBODIMENTS

Exemplary embodiments of the present disclosure provide firearms with a magazine track. One exemplary embodiment of the disclosure, as described below, is a lower receiver of an AR-15 style firearm that stores a plurality of individual ammunition magazines, i.e. reserve magazines, in a magazine track and allows the user to successively reload the AR-15 style firearm by automatic or semi-automatic means. The magazine track starts at the muzzle end of the AR-15 style firearm and runs parallel to the axis of the AR-15 style firearm. The magazine track is a storage arrangement comprised of a structure that includes two C-shaped grooves or channels separated by a space with the open sides of the C-shaped grooves facing each other. The reserve magazines are made suitable for insertion into the magazine track by modifying conventional magazines with a fitted magazine adapter.

As reserve magazines are initially inserted into the magazine track for storage, they compress a compression spring inside the magazine track and are stopped from being pushed back out by a reserve magazine catch. The reserve magazine catch allows magazines to be loaded into the magazine track and prevents magazines from leaving the magazine track until the reserve magazine catch is moved to a release position. The AR-15 style firearm with this disclosure is capable of successively reloading each individual reserve magazine in the magazine track into an active magazine well through semi-automatic means carried out by moving a structure or part (a "pump").

In one exemplary embodiment, the pump, which may be grasped and manually moved by a user, slides along the axis of the AR-15 style firearm, initially toward the buttstock and then back toward the muzzle to its starting position. Such movement of the pump provides the force actuating the movement of other parts to facilitate the magazine reloading process. The action of the pump moves two sets of interconnected lever arms with pivot points, one set on the left and right side of the lower receiver from a user's perspective. The first movement of the pump extends the ends of four levers (and the mirror-image set), which have dowels on them (and the mirror-image set) so that the dowels are under the active magazine well and aligned horizontally with the magazine track. After the levers reach their extended position, the reserve magazine catch is released and a reserve magazine is then moved underneath the active magazine well by the force of a compression spring. The reserve magazine is held in place under the active magazine well by the dowels (and the mirror-image set), which fit into the magazine adapter slot. The reserve magazine that was next in line toward the muzzle is also pushed toward the buttstock by the compression spring but is stopped by the reserve magazine catch, which has automatically returned to its initial position.

When the pump is pushed forward to its original position, the reserve magazine positioned under the active magazine well is then forced up into the active magazine well by the lever arms with dowels as they are moved back up by the pump movement. The reserve magazine movement has enough upward force to engage the active magazine catch & release before the lever arms are returned to their original position outside the active magazine well. This completes a semi-automatic reloading process of a magazine that is then capable of being used to continue firing and enabling positive user control of the firearm.

One advantage of the embodiments of the disclosure is that semi-automatic switching results in a magazine reload without the user having to perform a traditional manual exchange by hand of the spent active magazine with a full reserve magazine.

In an exemplary embodiment, the user will hold the AR-15 style firearm by the pump and slide the pump back and forward similar to how one would pump certain styles of shotguns. The process results in the user obtaining positive control because the user may focus exclusively on the target during the reloading process providing for superior safety through better situational awareness and also ensures that the firearm is never pointing at anything the user is not intending to shoot.

Another advantage of the embodiments of the disclosure is that unlike a single high capacity magazine, the present embodiment of the disclosure does not chain, latch or join in any way, the plurality of individual magazines together in such a fashion so as to continuously and directly feed the cartridges of the AR-15 style firearm. Each reserve magazine is still reloaded into, dispenses ammunition and is ejected out of the AR-15 style firearm separately. The individual magazines used in the AR-15 style firearm may be adapted to store the legally allowable amount of cartridges per individual magazine in order to remain complaint with applicable state law for civilian use or may be adapted exclusively for military or law enforcement use by adjusting the capacity of the individual magazines.

Another advantage of the embodiments of the disclosure is that the present embodiment will work with one or a plurality of magazines. If only one magazine operation is desired it may be inserted into the active magazine well 141 and pressed upward until it is held by the active magazine catch & release 144. The present embodiment may also be constructed such that it is compatible with fixed as well as detachable magazines, including using a mechanism commonly known in the art as a "bullet button."

These and other objects, features and advantages of the present invention will become apparent upon reading the following detailed description of exemplary embodiments of the present invention, when taken in conjunction with the appended drawings and claims.

BRIEF DESCRIPTION OF THE DRAWINGS

Further objects, features and advantages of the present invention will become apparent from the following detailed description taken in conjunction with the accompanying figures showing illustrative embodiments, results and/or features of the exemplary embodiments of the present invention, in which.

Figure 1:
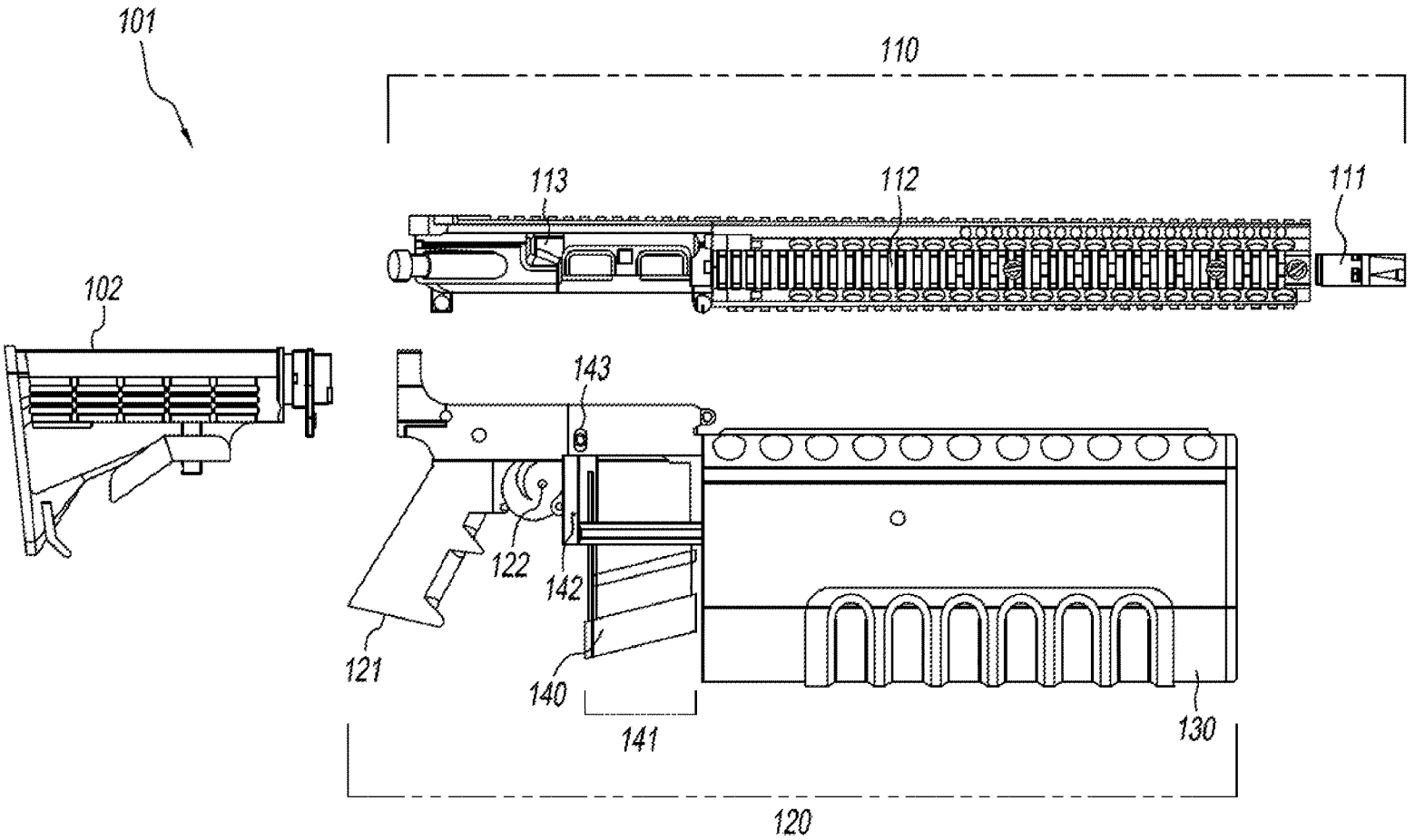
FIG. 1 shows an exemplary exploded side view of an AR-15 style firearm in accordance with certain embodiments of the present disclosure.

Throughout the drawings, the same reference numerals and characters, unless otherwise stated, are used to denote like features, elements, components, or portions of the illustrated embodiments. Similar features may thus be described by the same reference numerals, which indicate to the skilled reader that exchanges of features between different embodiments can be done unless otherwise explicitly stated. Moreover, while the present invention will now be described in detail with reference to the figures, it is done so in connection with the illustrative embodiments and is not limited by the particular embodiments illustrated in the figures. It is intended that changes and modifications can be made to the described embodiments without departing from the true scope and spirit of the exemplary embodiments of the present invention as defined by the appended claims.

DETAILED DESCRIPTION OF EXEMPLARY EMBODIMENTS

An exemplary firearm in accordance with certain embodiments of the present disclosure is shown in FIG. 1. The firearm 101 is an AR-15 style firearm, although other types of firearms can also be used with embodiments of the disclosure. The AR-15 style firearm 101 includes three major components as shown in FIG. 1: a lower receiver 120, an upper receiver 110, and a buttstock 102. The exemplary upper receiver can include a muzzle 111 (shown separated from the upper receiver 110 in FIG. 1), a barrel 112, and a bolt mechanism 113. The lower receiver 120 can include a pistol grip 121, a trigger component 122, an active magazine release button 143, an active magazine well wall 142, and an active magazine 140 positioned in the active magazine well 141. The active magazine 140 is a magazine that can contain a plurality of cartridges (not shown) and feed the cartridges sequentially into the firing chamber.

As used herein, the term "button" can refer to any component that may be acted upon by a user to initiate one or more mechanical or automated actions carried out by one or more mechanisms or arrangements in the apparatus being described. For example, a button can include, but is not limited to, a conventional protrusion that can be depressed by, a switch, a lever, e.g. that may rotate around a pivot, or a knob, handle, or the like that may be configured to twist or slide in a track or guide. A button can optionally be configured to return to an initial or resting position when released, e.g., by the action of a spring, a resilient material, a mechanical arrangement, or the like.

Unlike conventional firearms, the lower receiver 120 of the AR-15 style firearm 101 includes an exemplary pump 130. Because many firearms (such as the AR-15 style firearm) may have a standardized modular design, embodiments of the present disclosure can include or provide a lower receiver 120 that matches the industry standard dimensions for interconnection, allowing it to connect to compatible upper receivers 110 and/or buttstocks 102 from any manufacturer that follows such standard dimensions at the relevant points.

Providing one or more reserve magazines in the present invention may be performed in a variety of ways. In one exemplary embodiment of a storage arrangement, shown in FIG. 2A, reserve magazines 210 can be stored in the magazine track 200. For example, the lower receiver 120 can optionally be inverted (for ease of handling), and a reserve magazine 210 can be stored onto the magazine track 200 by positioning the reserve magazine 210 partially in the active magazine well 141 such that a magazine adapter 212 on the reserve magazine 210 (shown in FIG. 3) aligns with grooves provided along at least a portion of the length of the magazine track 200. The reserve magazine 210 can then be slid into the magazine track 200 towards the distal or muzzle end of the magazine track 200, pushing against a sliding follower 201 and compression spring 202 that may be provided in the magazine track 200. The distal end of the compression spring 202 can be held in the magazine track 200, e.g., by providing a pump wall 501 or the like at a distal end of the magazine track 200. The reserve magazine 210 can be retained in the magazine track 200, e.g., by a reserve magazine catch 502 (shown in FIG. 5) or other similar retention arrangement.

Figure 2A:
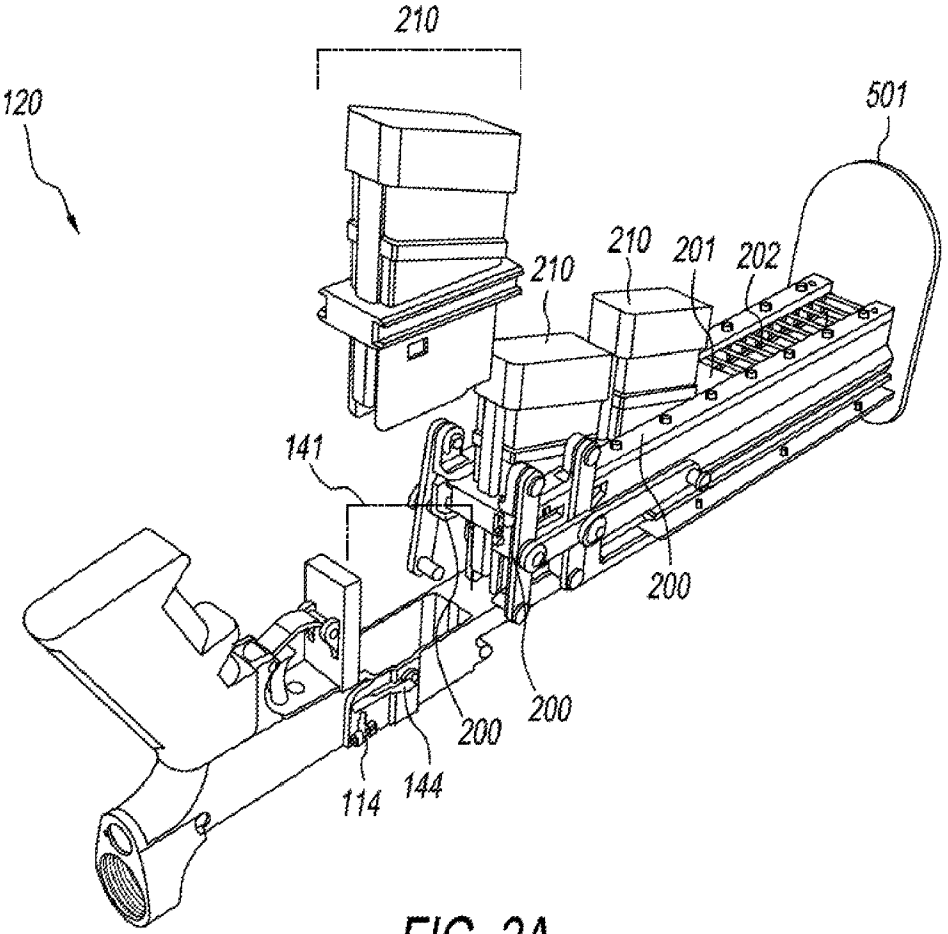
FIG. 2A is an inverted perspective view of the exemplary firearm shown in FIG. 1 with a pump removed for clarity.
Figure 2B:
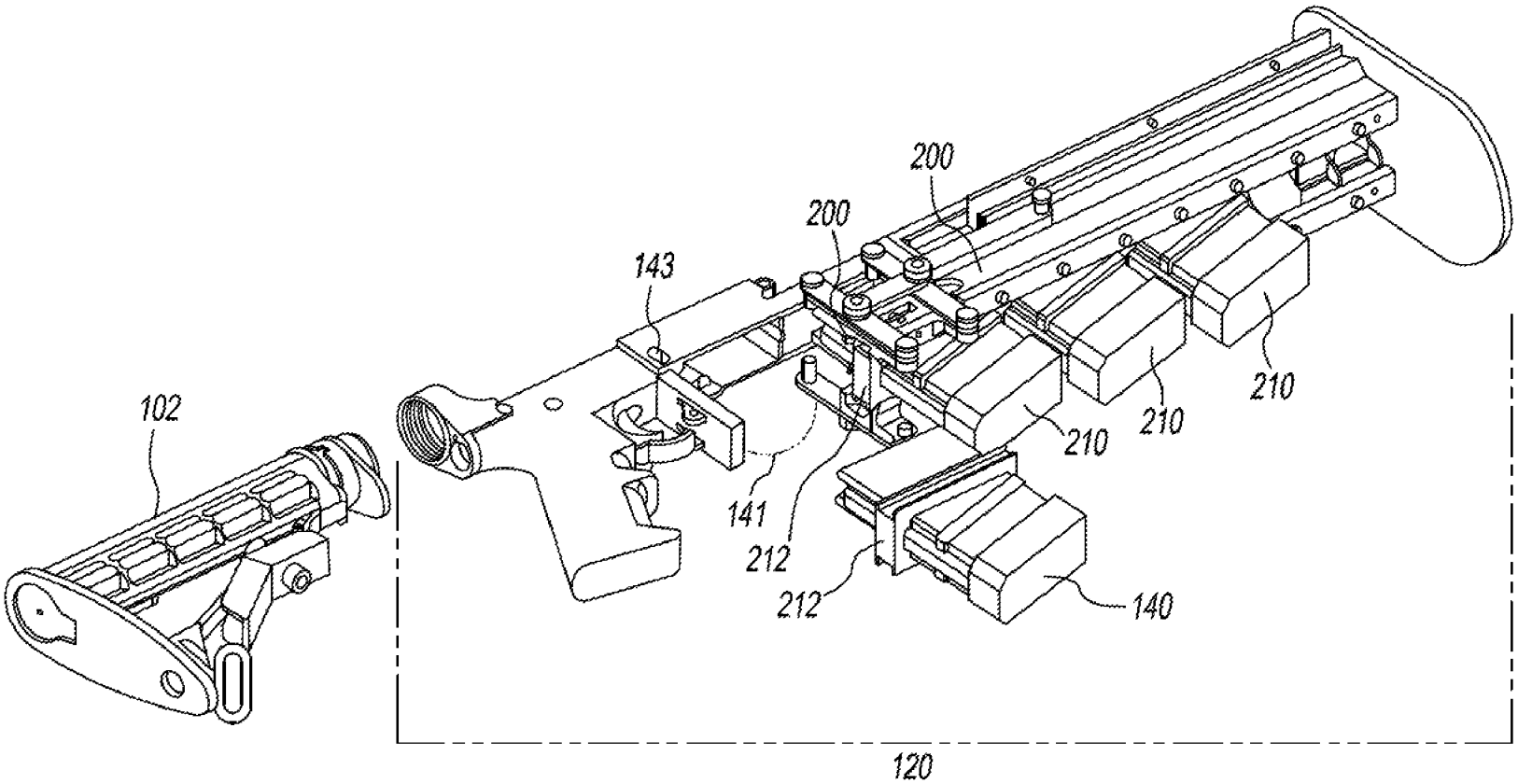
FIG. 2B is angled sideways perspective view of the bottom of the exemplary firearm shown in FIG. 2A.

FIG. 2B shows the exemplary lower receiver 120 of FIG. 2A after a third reserve magazine 210 has been stored in the magazine track 200, with an active magazine 140 being positioned for insertion into the active magazine well 141. The active magazine 140 can be retained in the active magazine well 141, e.g., by a conventional magazine catch-and-release arrangement comprised of an active magazine catch and release 144, which can be activated by an active magazine release button 143, or the like.

Figure 3:
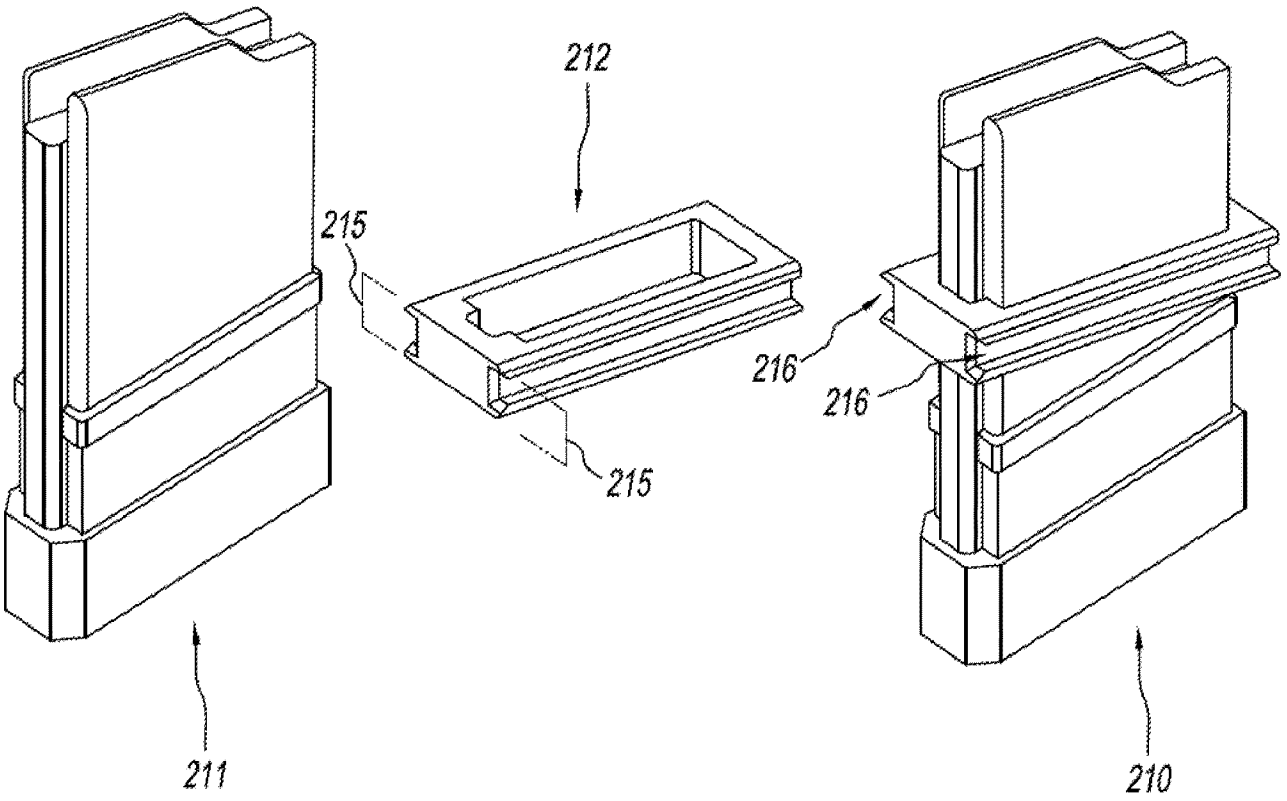
FIG. 3 shows an angled perspective view of a conventional magazine and a magazine adapter, in separated and assembled configurations, in accordance with certain embodiments of the present disclosure.

As shown in FIG. 3, the reserve magazine 210 can include a conventional magazine 211 and a magazine adapter 212 that fits around the conventional magazine 211. The magazine adapter 212 can be affixed to the conventional magazine 211, e.g., by specifying the shape of the central opening of the magazine adapter 212, by friction, by an adhesive substance, by welding the two components together, and/or by spacers or protrusions (not shown) provided on the reserve magazine 210 and/or the conventional magazine 211. The magazine adapter 212 may be comprised of a single piece or multiple pieces that can be affixed to the conventional magazine 211. In further embodiments of the disclosure, the reserve magazine 210 can be formed as a single unit that includes the overall shape and functionality of the assembled conventional magazine 211 and a magazine adapter 212.

The magazine adapter 212 can be provided with edge protrusions 215 that run along the lateral sides of the magazine adapter 212. The edge protrusions 215 can be shaped to fit into corresponding magazine track grooves 217 provided along the inside walls of the magazine track 200 (shown in FIGS. 4A and 4B). Such exemplary configuration can facilitate a longitudinal translation or sliding of the reserve magazine 210 along at least a portion of the magazine track 200, as well as a retention of the reserve magazine(s) 210 within the magazine track 200. These edge protrusions 215 can further define magazine adapter slots 216 that can run along the outer edges of the magazine adapter 212, as shown in FIG. 3. These exemplary features of the magazine adapter 212 can be configured to interact with other components of the exemplary AR-15 style firearm 101 to facilitate automatic or semi-automatic reloading of stored reserve magazines 210 into the active magazine well 141, as described in more detail herein.

Figure 4A:
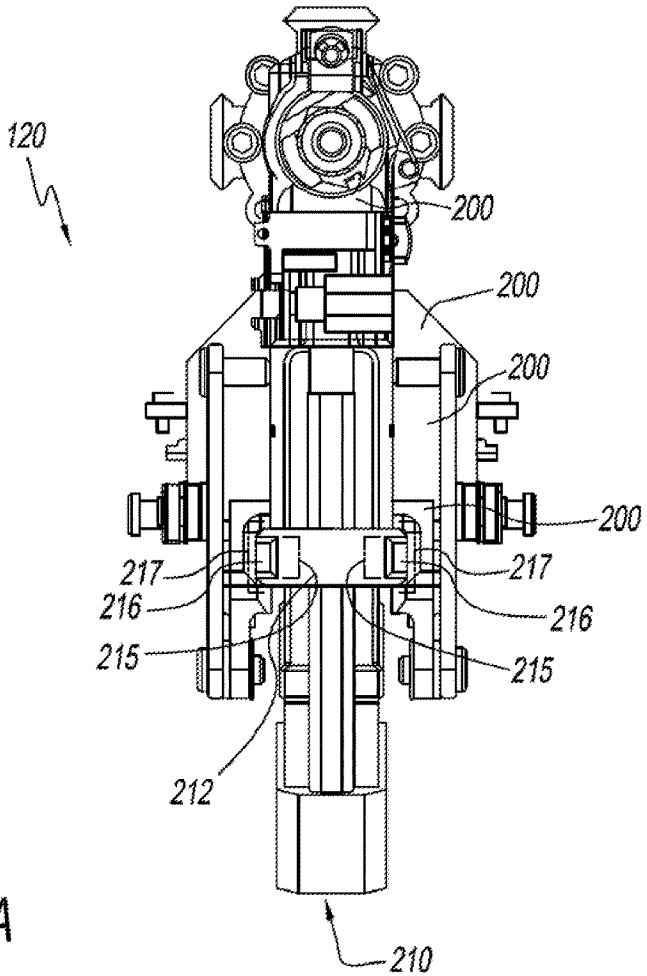
FIG. 4A is a cross-sectional end view of the exemplary firearm shown in FIG. 2A.
Figure 4B:
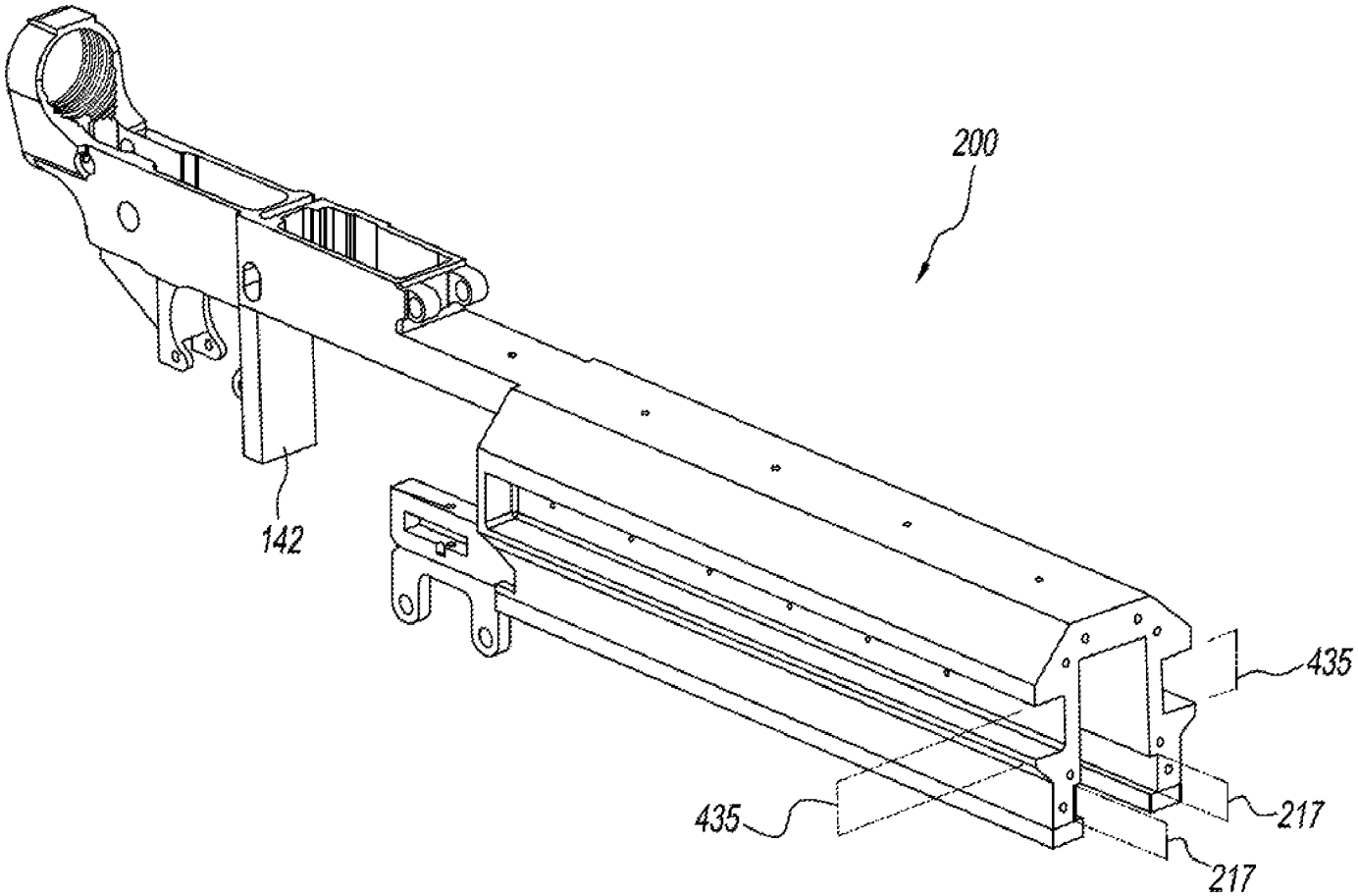
FIG. 4B is an angled perspective view of the side and top of the magazine track and its associated structures in accordance with certain embodiments of the present disclosure.

FIG. 4A shows an end view of a lower receiver 120, where a reserve magazine 210 with the magazine adapter's two edge protrusions 215 is located within the magazine track grooves 217 of the magazine track 200. The exemplary magazine track 200 shown in FIG. 4B can include the magazine track grooves 217, active magazine well wall 142, and longitudinal pump grooves 435 that may run longitudinally along at least a portion of the outer sides of the magazine track 200. These pump grooves 435 can facilitate lateral translation of the pump 130 along the pump grooves 435 to facilitate reloading of reserve magazines 210 in certain embodiments of the present disclosure.

Some components of the exemplary AR-15 style firearm 101 may be formed from a single piece of material, whereas other components may be formed separately and attached (as appropriate) permanently or with fasteners. For example, the active magazine well wall 142 shown in FIG. 4B may be formed as part of the magazine track 200, or optionally it may be formed as a separate component and affixed to the magazine track 200. Different structural options, configurations, and details may be used to provide the various functions of the exemplary embodiments described herein. Selection of such options for a particular embodiment can be based on various reasons including, but not limited to, improved component and manufacturing costs, and ease of assembly or repair of broken or worn parts. For example, a height-adjustment arrangement that can set how deep a reserve magazine is inserted into the active magazine well may be included. This height-adjustment arrangement may include a replaceable shim adjacent to the magazine track 200 such that shims of various shapes or thicknesses can be used to control the depth to which the reserve magazine 210 is moved into the active magazine well 141.

Figure 5:
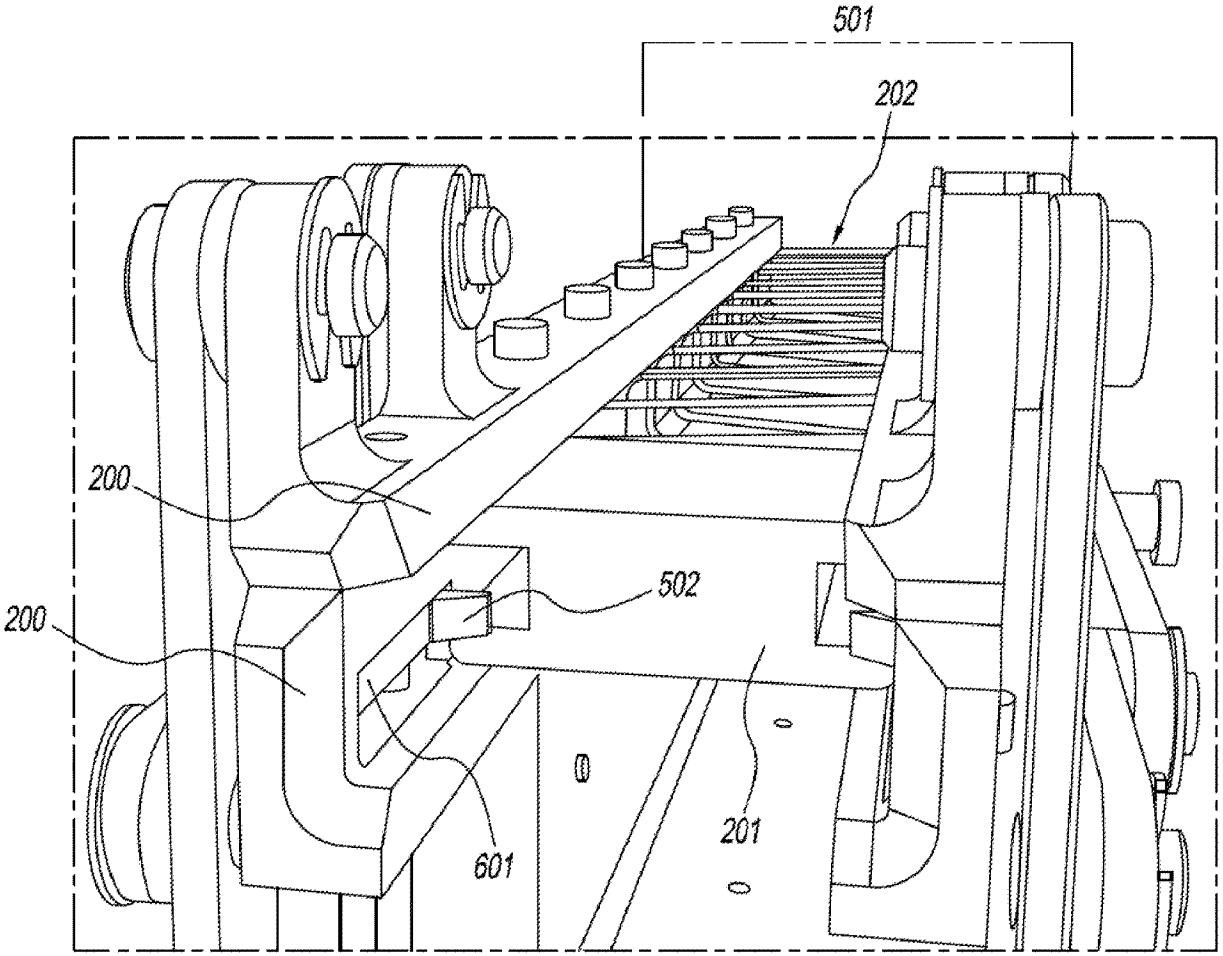
FIG. 5 is a perspective end view of the magazine track showing a compression spring and follower that can facilitate storage and reloading of reserve magazines.

FIG. 5 is a view of the inside of the exemplary magazine track 200 looking towards the distal end thereof. A follower 201 can be configured to slide within the magazine track grooves 217 in the magazine track 200. The follower 201 may be generally pushed toward the proximal end of the magazine track 200, e.g., by a compression spring 202 also located within the magazine track 200, where the distal end of the compression spring 202 may be fixed to or constrained by the pump wall 501. In certain embodiments, the follower 201 can be formed of an ultra-high molecular weight polyethylene ("UHMW-PE"). A reserve magazine catch 502 can be configured to prevent the follower 201 from sliding out of the proximal end of the magazine track 200. As a first reserve magazine 210 is inserted into the magazine track 200 and pushes against the follower 201, the follower 201 may slide back into the magazine track 200 toward the pump wall 501, thereby compressing the compression spring 202 and producing a force on the reserve magazine 210 directed towards the proximal end of the magazine track 200 and the active magazine well 141.

Figure 6:
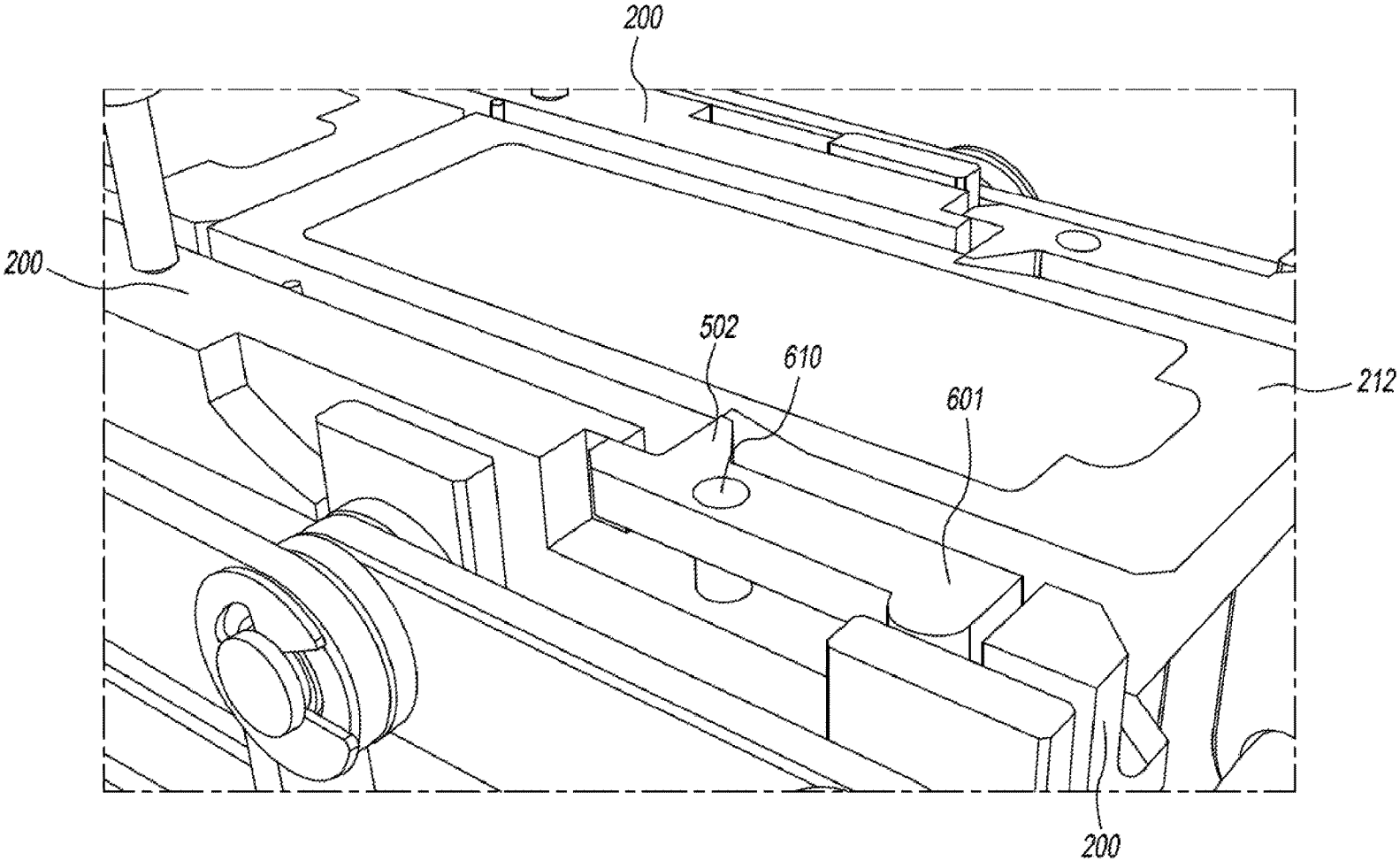
FIG. 6 is a perspective close-up view of a portion of the magazine track and associated reserve magazine release lever in accordance with certain embodiments of the present disclosure.

Once pushed into the magazine track 200, the reserve magazines 210 can be constrained from sliding out of the magazine track 200 and into the active magazine well 141. For example, as shown in FIG. 6, a reserve magazine catch 502 may be provided near the proximal end of the magazine track 200. The reserve magazine catch 502 can be configured to act as a one-way ratchet mechanism that allows the reserve magazines 210 to be pushed towards the distal end of the magazine track 200. A reserve magazine release lever 601 can be pivotally coupled to the reserve magazine catch 502, e.g., across a pivot point 610, and an associated torsion spring or the like (not shown) can be provided such that the resting state of the magazine catch 502 can prevent the reserve magazines 210 from exiting the proximal end of the magazine track 200, e.g., into the active magazine well 141. If a reserve magazine 210 is being retained within the magazine track 200 by the reserve magazine catch 502, another reserve magazine 210 may then be inserted into the magazine track 200 in the same fashion as the first. A further reserve magazine 210 that is stored after the first one will push against the previously inserted reserve magazine(s) 210 and further compress the compression spring 202, e.g., until a particular portion of the further reserve magazine 210 passes the reserve magazine catch 502 that will then hold it within the magazine track 200.

Figure 7:
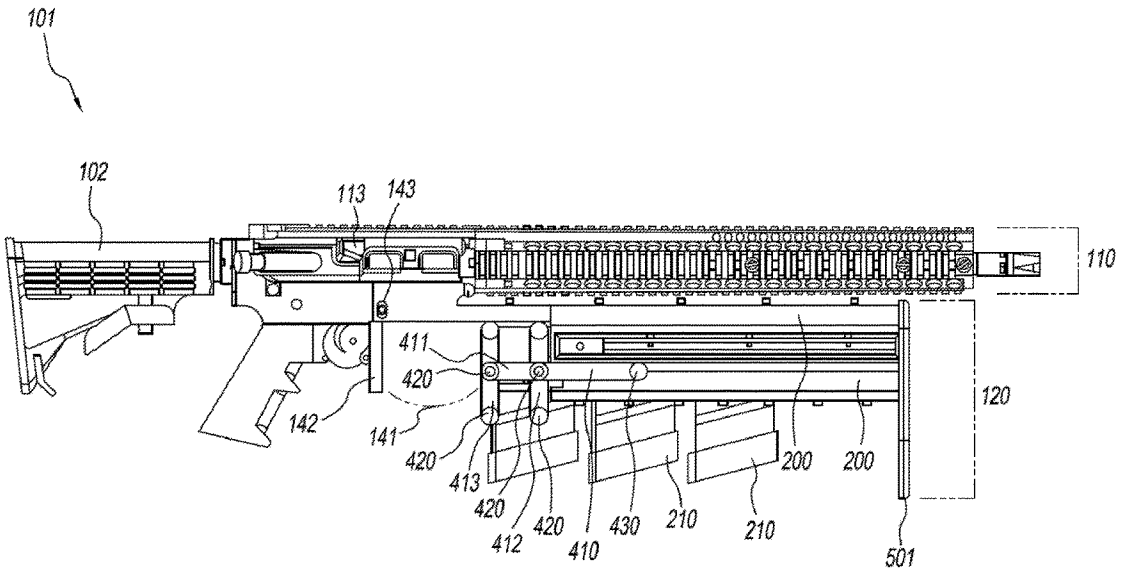
FIG. 7 is a side view of an exemplary AR-15 style firearm with the pump removed for clarity to show an exemplary lever arrangement for reloading spare magazines in accordance with certain embodiments of the present disclosure.

The magazine reloading process can be continued until the compression spring 202 is fully compressed and the follower 201 is at its farthest position away from the active magazine well 141, which results in filling up the magazine track 200 as shown in FIG. 7. In this embodiment, enough room is left in the distal portion of the magazine track 200 (i.e., the portion closest to the muzzle end and pump wall 501 of the firearm) to allow space for the compressed compression spring 202 and follower 201 therein when the reserve magazines 210 are stored in the magazine track 200. The magazine track 200 need not be filled to maximum capacity with reserve magazines 210 to use the firearm.

After the initial storing of reserve magazines 210 is completed, an active magazine 140 can be inserted into the active magazine well 141, e.g., using conventional magazine loading procedures. For example, an active magazine 140 can be inserted into the active magazine well 141 and pushed upward toward the upper receiver 110 until it is held by the active magazine catch-and-release 144 on the lower receiver 120, thereby making it the active magazine 140 as shown, e.g., in FIG. 11A.

With an active magazine 140 in the active magazine well 141, a conventional bolt catch-and-release 114 such as that shown in FIG. 2A can be activated. Once released by the bolt catch-and-release 114, the bolt mechanism 113 in the upper receiver 110 can receive a cartridge (not shown) from the active magazine 140 and move it into a position for firing. If the initial loading process was begun without first pulling back and catching the bolt mechanism 113 on the upper receiver 110, as is common, then this release step may be unnecessary. After some or all of the cartridges in the active magazine 140 have been fired, the magazine reloading procedure described below may begin.

For example, if an active magazine 140 is in the active magazine well 141, it can first be removed from the active magazine well 141. This can be done for a conventional AR-15 style rifle or the like by first pressing the active magazine release button 143 on the lower receiver 120, thereby opening the active magazine catch-and-release 144 that holds the active magazine 140 in the active magazine well 141 to allow the active magazine 140 to be removed from the active magazine well 141 or fall out of the active magazine well 141 due to gravity. Releasing the active magazine release button 143 can return the active magazine catch-and-release 144 back into its standard closed position. Once the active magazine well 141 is empty, exemplary embodiments of the present disclosure can facilitate reloading of a reserve magazine 210 into the active magazine well 141 as follows.

FIG. 7 shows the exemplary AR-15 style firearm 101 with an empty active magazine well 141, three reserve magazines 210 initially stored in the magazine track 200, and exemplary lever arms 410, 411, 412, 413 that are pivotally coupled and located proximal to the active magazine well 141. The pump 130 is not shown in FIG. 7 to more clearly show the arrangement of the lever arms 410, 411, 412, 413.

Figure 8:
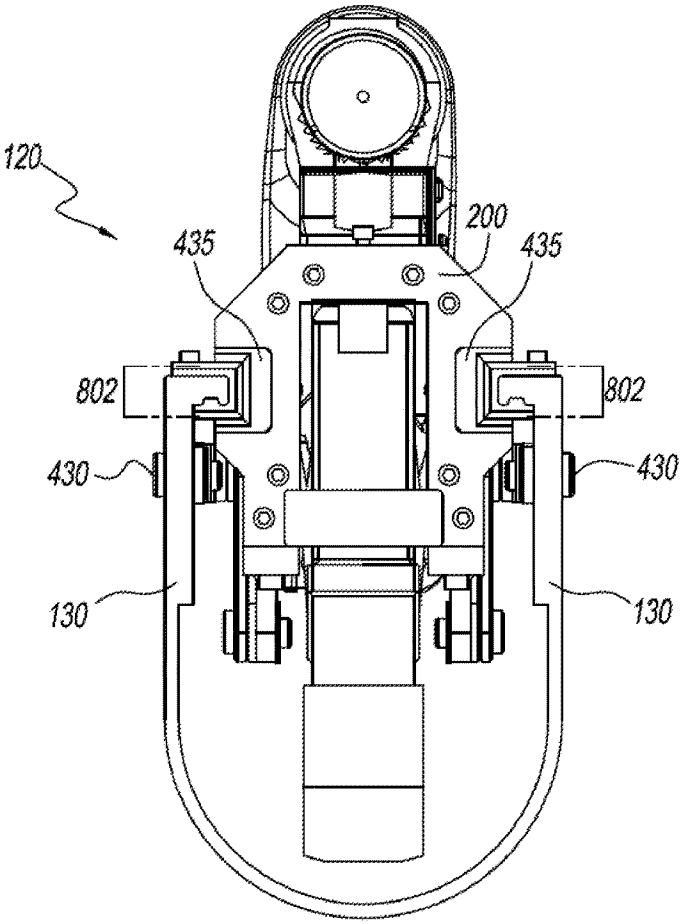
FIG. 8 is a cross-sectional end view from the muzzle end showing the shape of the pump and receiving grooves in the magazine track.

FIG. 1 shows the pump 130 from a side perspective in its starting position. It can be configured to translate laterally along the length of the magazine track 200, e.g., toward the active magazine well 141 and back to its original position. Such translation can be guided by pump tongues 802, which can be affixed to—or optionally formed as part of—the pump 130 and configured to fit into the pump grooves 435 provided on the outer sides of the magazine track 200 as shown in FIG. 8, to facilitate such sliding motion. The pump 130, described in more detail below, may be physically constrained from sliding towards the active magazine well 141 if an active magazine 140 is present in the active well 141. In certain embodiments, the pump 130 can be formed from an engineering plastic, a metal or alloy, a composite material, or the like.

An exemplary reloading procedure for reserve magazines 210 is now described in terms of certain exemplary levers, pivot points, and connections provided on one side of the lower receiver 120. Embodiments of the present disclosure can include a mirror-image set of these levers, pivot points, and connections provided on the opposite side of the lower receiver 120, which may perform the same functions of engaging and moving the reserve magazines 210 by engaging them on their opposite side of the AR-15 style firearm 101. Such mirrored components can provide improved balance of mechanical functions, e.g., to reduce wear and/or stresses on components, and are visible in certain figures.

Figure 9A:
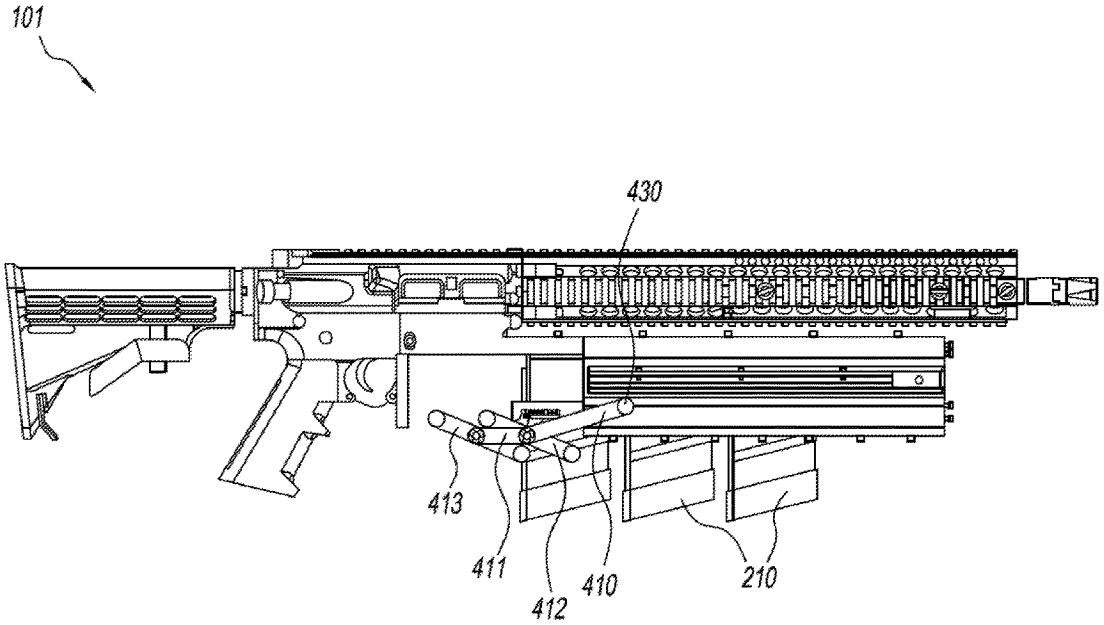
FIG. 9A is a side view of the exemplary firearm shown in FIG. 7 where the lever arm arrangement is extended before a reserve magazine has been released.

After removal of the active magazine 140 from the AR-15 style firearm 101, movement of the pump 130 can initiate reloading of a reserve magazine 210 into the active magazine well 141. For example, sliding the pump 130 to its furthest position towards the buttstock 102 can cause direct movement of the first lever arm 410 that is pivotally coupled to the pump 130 at its distal end through pivot 430, as shown in FIG. 9A. The movement of the first lever arm 410 in turn can move exemplary lever arms 411, 412, and 413 from their initial (resting) positions shown in FIG. 7 to the positions shown in FIG. 9A. The first lever arm 410 is moved proximally toward the buttstock 102 by the pivoting pump connector 430, and the proximal end of the first lever arm 410 will simultaneously move backward as well as downward, e.g., as shown by comparing FIG. 7 with FIG. 9A. The proximal end of first lever arm 410 is rotatably coupled by a pivot point 420 to the distal end of the second lever arm 411 and to the central portion of third lever arm 412, as shown, e.g., in FIGS. 9A and 9B. The proximal end of the second lever arm 411 is also rotatably coupled by another pivot point 420 to the central portion of the fourth lever arm 413 as also shown, e.g., in FIGS. 9A and 9B. The distal ends of the third lever arm 412 and fourth lever arm 413 are each rotatably coupled to the lower receiver 120 by further pivot point 420.

Figure 9B:
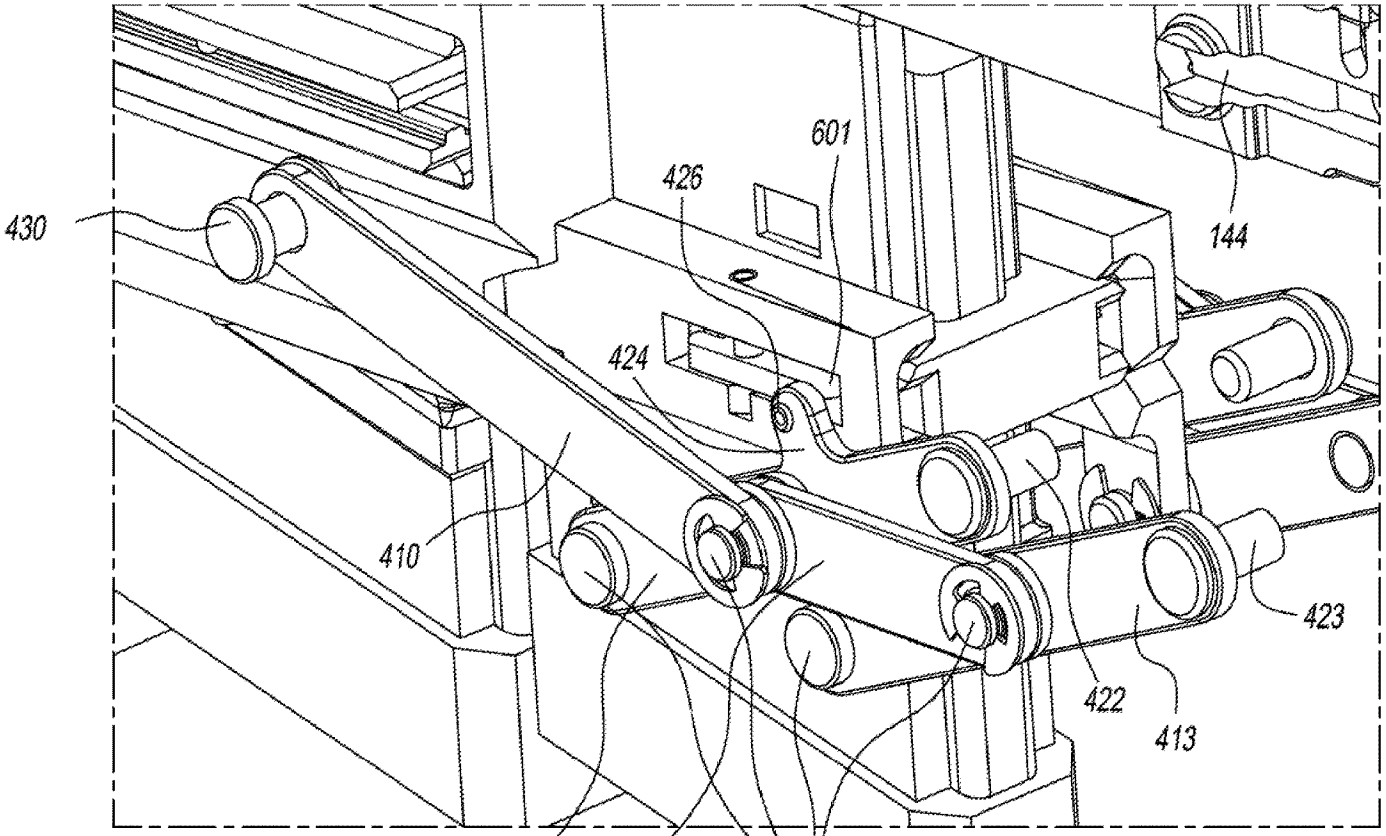
FIG. 9B is a close-up view of the exemplary lever arrangement showing a reserve magazine release trigger contacting a reserve magazine release lever.

The exemplary configuration of the lever arms 410, 411, 412, 413, pivoting pump connector 430 and pivot points 420 causes the upper/proximal ends of lever arms 412, 413 to move proximally (i.e. towards the buttstock 102) and downward when the pump 130 is translated toward the buttstock 102, whereas the second lever arm 411 that is pivotally coupled to the central portions of lever arms 412, 413 remains substantially horizontal. This coordinated motion of the pump 130 and lever arms 410, 411, 412, 413 is illustrated by comparing FIGS. 7, 9A and 9B. After this lateral movement of the pump 130, shown in FIG. 9, the proximal/top ends of the third lever arm 412 and fourth lever arm 413 are at substantially the same height and can be configured to line up horizontally with the axis of the magazine track grooves 217 provided in the magazine track 200. As shown in FIG. 9B, fixed dowels 422, 423 are provided at the proximal ends of lever arms 412, 413, respectively. The dowels 422, 423 protrude inward from the levers 412, 413 toward the magazine track grooves 217. These dowels 422, 423 are horizontally aligned with the magazine track grooves 217 when the pump 130 is fully translated towards the proximal/buttstock end of the AR-15 style firearm 101, such that when a reserve magazine 210 is pushed off the magazine track 200 in the next reloading step, the magazine adapter slots 216 will slide over dowel 422 and dowel 423 (and over their counterparts on the opposite side of the lower receiver 120) to position the reserve magazine 210 under the active magazine well 141.

Figure 10A:
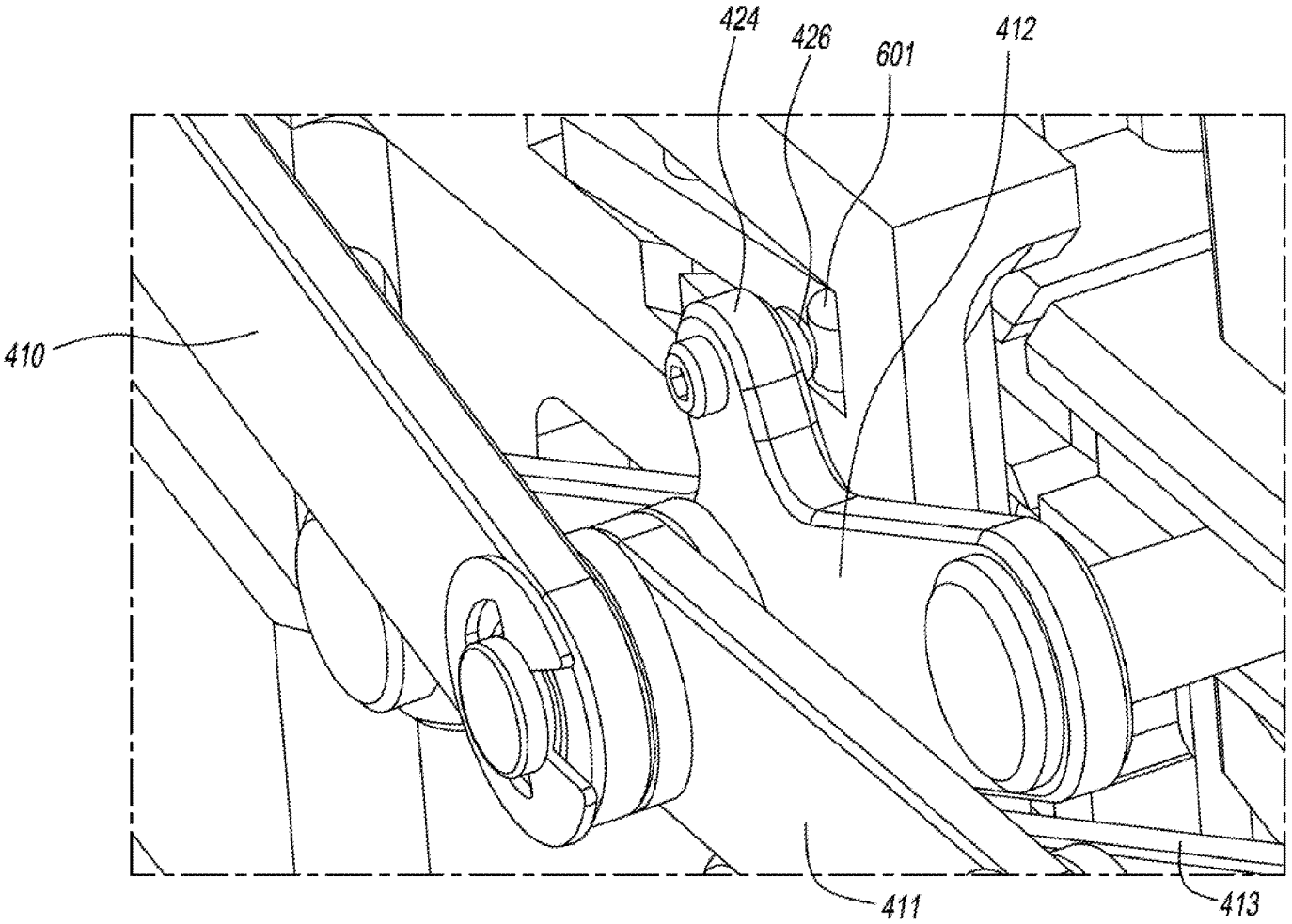
FIG. 10A is another close-up view of the exemplary lever arrangement showing a set screw contacting the reserve magazine release lever.
Figure 10B:
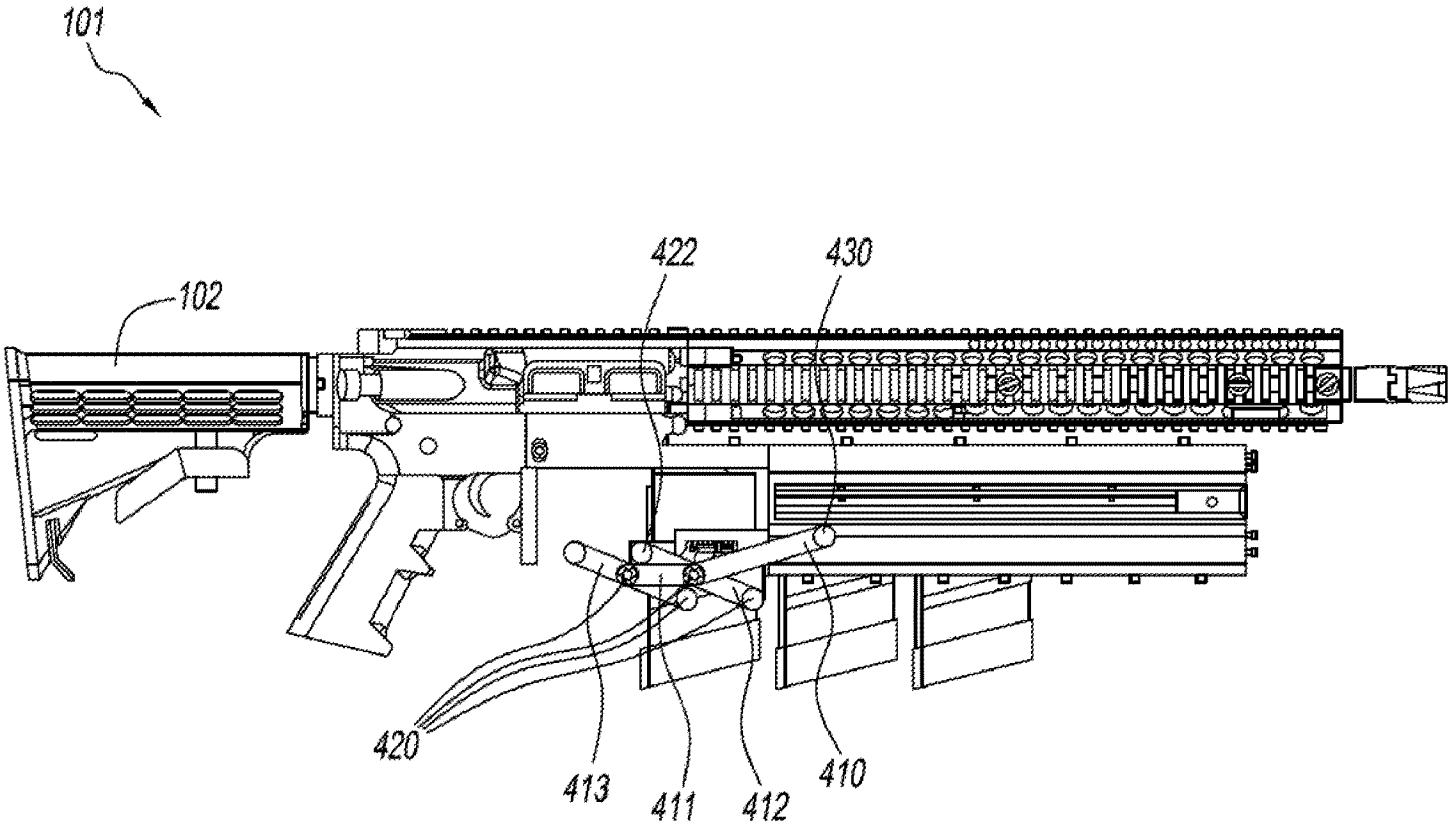
FIG. 10B is a side view of the exemplary firearm shown in FIG. 9A where a reserve magazine has been released and moved onto a dowel at one end of the lever arm arrangement.

A further reloading step can be actuated at or near the end of the first proximal translation of the pump 130. For example, as shown in FIG. 10A, the third lever arm 412 can be provided with a reserve magazine release trigger 424 that is configured to push on the reserve magazine release lever 601 when the proximal end of the lever arm 412 is moved proximally as described herein. The reserve magazine release trigger 424 can optionally include an adjustable setscrew 426 or the like that can be adjusted to control the amount of force exerted on the reserve magazine release lever 601 when the lever arm 412 moves. The reserve magazine release lever 601 is coupled to the reserve magazine catch 502, as shown in the exemplary configuration of FIG. 6. When the reserve magazine release lever 601 is pressed inward toward the center of the magazine track 200, the reserve magazine catch 502 will move in the opposite direction around the pivot 610, thereby moving the magazine catch 502 out of the magazine track groove 217. Once the reserve magazine catch 502 is released in this manner, any reserve magazines 210 stored in the magazine track 200 will slide toward the active magazine well 141 due to the pressure of the compression spring 202. With this movement, the reserve magazine 210 closest to the active magazine well 141 can be pushed out of the proximal end of the magazine track 200, and the magazine adapter slots 216 can initially slide onto dowels 422 as shown, e.g., in FIG. 10B. This first reserve magazine 210 can then continue to slide out of the magazine track 200 such that the magazine adapter slots 216 then slide onto dowels 422, 423. The reserve magazine 210 will stop sliding when the magazine adapter 212 contacts the active magazine well wall 142. Dowels 422 and 423 (and their mirror-image dowels) hold the reserve magazine 210 under the active magazine well 141 as shown in FIG. 10B, preventing this magazine 210 from falling out of the active magazine well 141.

Figure 10C:
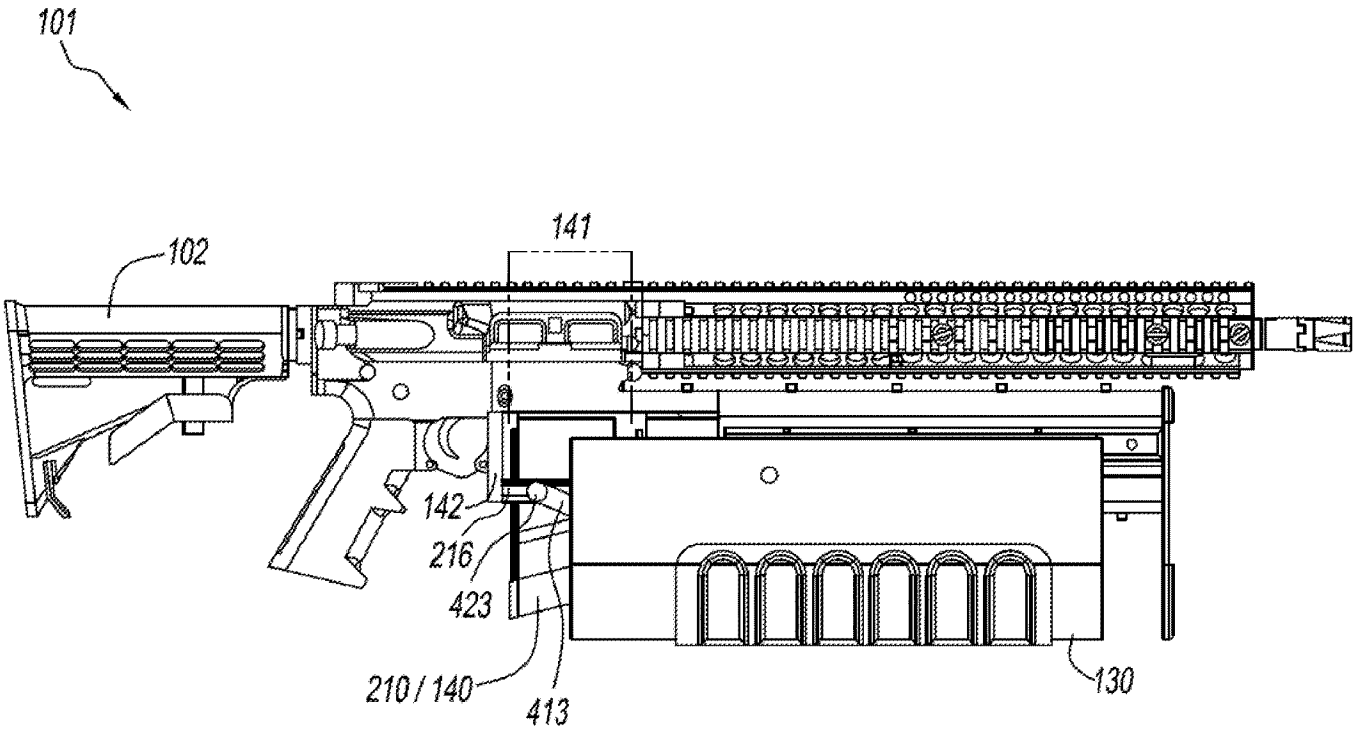
FIG. 10C is a side view of the exemplary firearm shown in FIG. 10B with the pump in place, showing a reserve magazine positioned in the active magazine well lever arm.

FIG. 10C shows perspective side view of the magazine adapter slot 216 that has slid onto the dowels 422, 423, although only dowel 423 is visible beyond the proximal end of the pump 130 in this figure. The reserve magazine 210 that was pushed into the active magazine well 141 stops its lateral movement when it reaches the active magazine well wall 142, which can be configured to extend downward to reach the level of the magazine adapter 212.

In one exemplary embodiment, the active magazine well wall 142 and trigger components 122 may be modified from a conventional lower receiver design such that when the magazine adapter 212 contacts the active magazine well wall 142, the reserve magazine 210 is positioned directly under the active magazine well 141, such that the reserve magazine 210 can slide directly upward along the active magazine well wall 142 until it engages with the active magazine catch-and-release 144. The reserve magazine catch 502 can return to a locked position after the first reserve magazine 210 exits the proximal end of the magazine track 200, e.g., by the force of a return spring or the like, such that the reserve magazine catch 502 will prevent a next reserve magazine 210 from sliding out of the magazine track 200. If a further reserve magazine 210 is stored in the magazine track 200, it will also be prevented from exiting the magazine track 200 by the presence of the next reserve magazine 210.

Figure 10D:
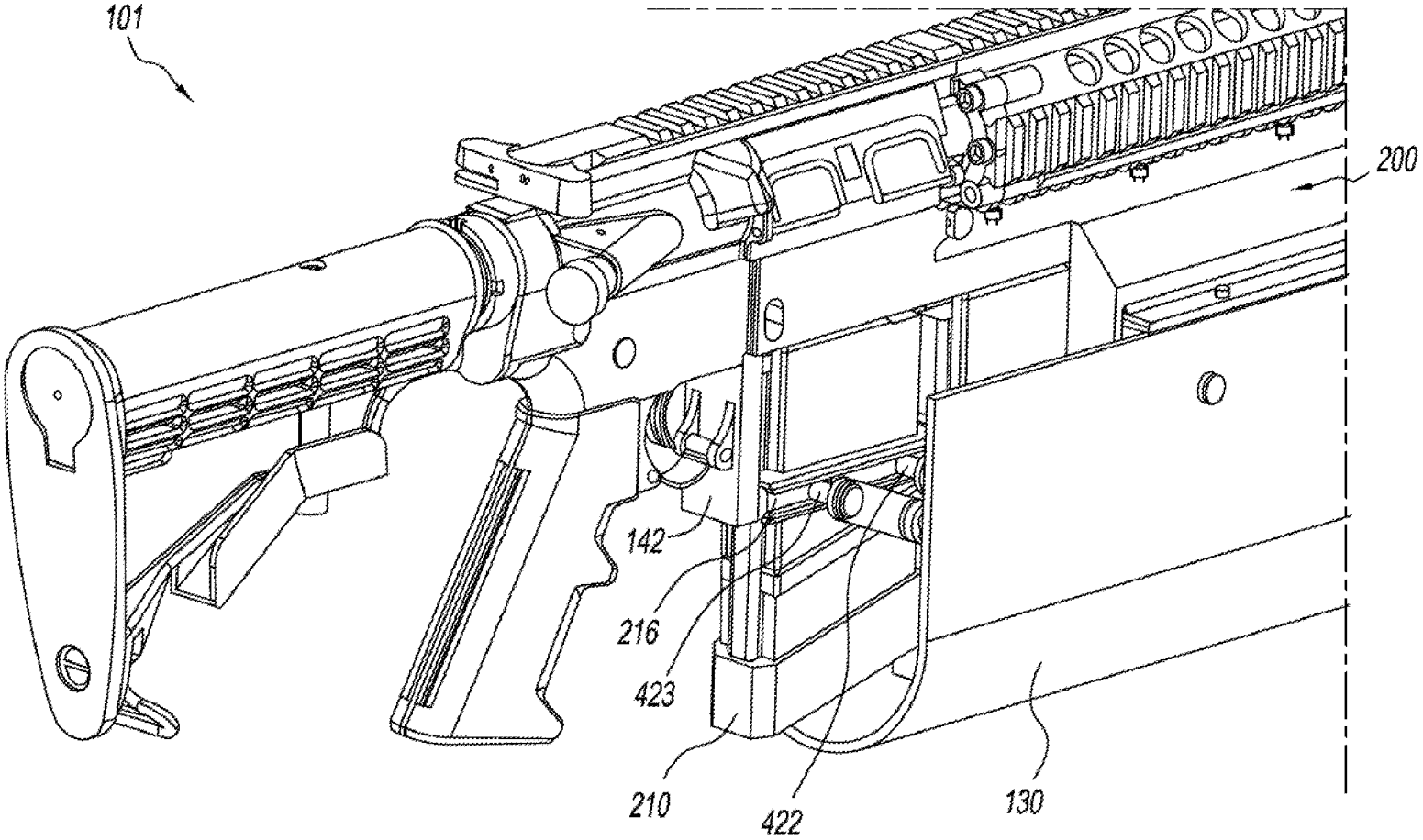
FIG. 10D is angled perspective view of the exemplary firearm shown in FIG. 10C showing the reserve magazine after it has slid off the magazine track and has engaged with dowels associated with the lever arrangement.

FIG. 10D shows the exemplary AR-15 style firearm 101 with the pump 130 at the end of its first motion toward the buttstock 102 and the reserve magazine 210 held under the active magazine well 141. A further motion of the pump 130 towards the distal/muzzle end of the AR-15 style firearm 101 can complete the reloading of a reserve magazine 210 such that it now becomes the active magazine 140. For example, translating the pump 130 toward the distal end of the AR-15 style firearm 101 can reverse the motions of the levers 410, 411, 412, 413 back toward their initial position shown in FIG. 7. However, the reserve magazine 210 now located in the active magazine well 141 is now engaged with dowels 422 and 423 (and with corresponding dowels on the opposite side of the lower receiver 120). As can be seen by comparing FIG. 9A with FIG. 7, the movement of dowels 422 and 423 will be upward and forward toward the distal muzzle end of the AR-15 style firearm 101. The reserve magazine 210 located in the active magazine well 141 can then be pushed upward in the active magazine well 141 by the dowels 422, 423 as they slide along the magazine adapter slots 216 while moving upward toward their starting positions (shown in FIG. 7).

Figure 11A:
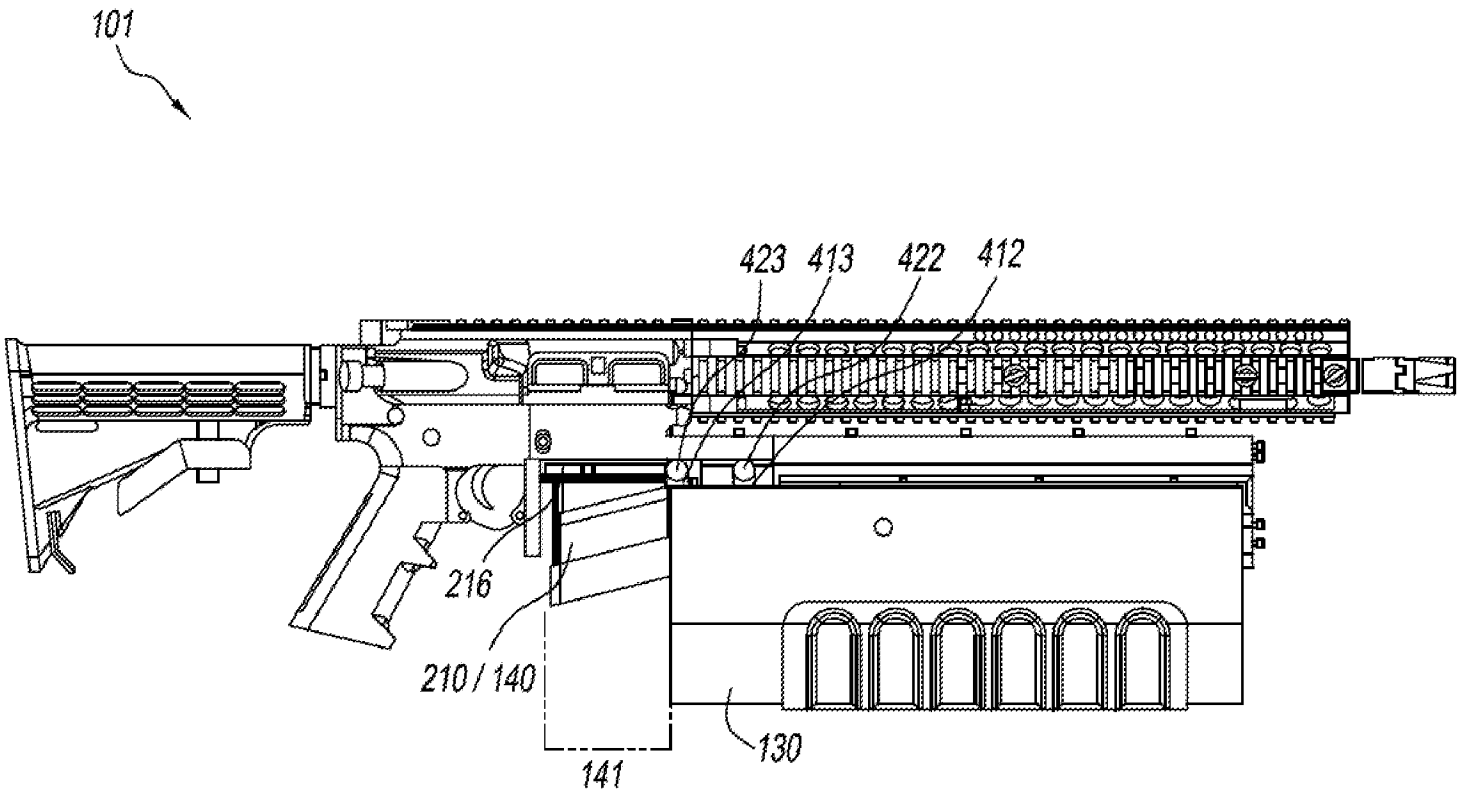
FIG. 11A is a side view of the exemplary firearm shown in FIG. 10C with the pump returned to a forward position and the reserve magazine inserted into the active magazine well.
Figure 11B:
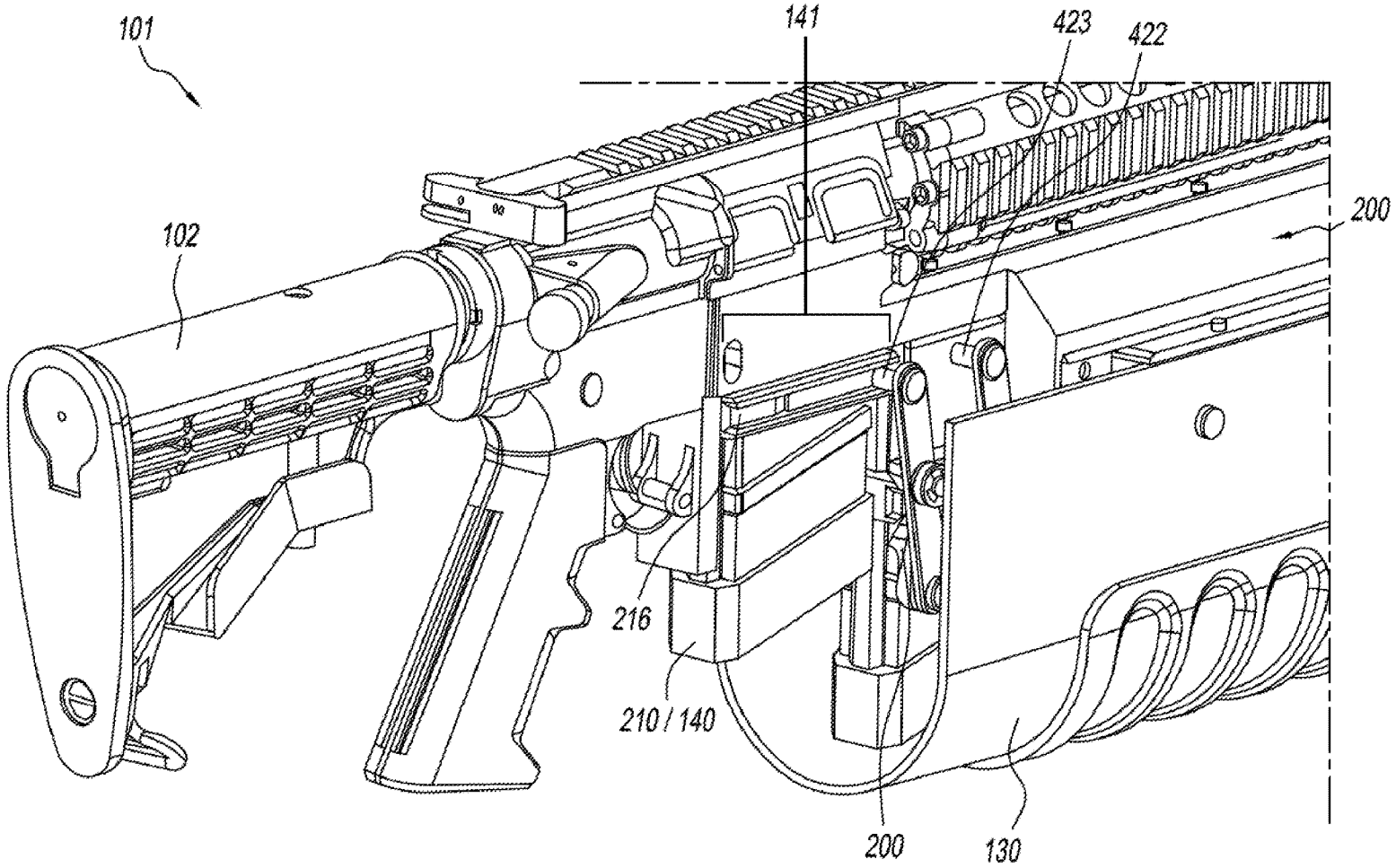
FIG. 11B is angled close-up perspective view of a portion of the exemplary firearm shown in FIG. 11A.

Just before the pump 130 is translated all the way forward (toward the muzzle end), dowel 423 finishes pushing the replacement magazine 210/140 upward such that it can engage the active magazine catch-and-release 144, which holds it in place, as shown in FIGS. 11A and 11B. The dowel 423 also slides completely out of the magazine adapter slot 216, such that the levers 410, 411, 412, 413 have each returned to their respective starting position as shown in FIG. 7 and are clear of the active magazine well 141.

With a new reserve/active magazine 210/140 now locked place, the conventional bolt catch-and-release arrangement 114 on the lower receiver 120 can be activated, such that the bolt mechanism 113 in the upper receiver 110 will convey a cartridge from the new active magazine 210/140 and move it into a position for firing. This step may be unnecessary, e.g., if the reloading process was begun without first pulling back the bolt mechanism 113 on the upper receiver 110.

In an alternative embodiment of the present disclosure, an AR-15 style firearm 101 or the like can be provided wherein any two or more of the upper receiver 110, the lower receiver 120, and the buttstock 102 may be permanently attached to each other. In still further embodiments, a magazine track 200, pump 130 and lever arms 410, 411, 412, 413 (as well as other related components described herein) or their functional equivalents can be provided with other types of firearms (e.g., automatic or semi-automatic pistols or the like) to facilitate storage and automatic or semi-automatic reloading of one or more reserve magazines as described herein.

The exemplary embodiment of the disclosure illustrated in FIG. 7 includes a magazine track 200 that is configured to store three reserve magazines 210. In still further exemplary embodiments, an AR-15 style firearm 101 can be provided with a magazine track 200 that is configured to store one, two or more than three reserve magazines 210.

The magazine track 200 and associated components may be composed of the same or different materials. Component materials that may be used in exemplary embodiments of the present disclosure include, but are not limited to, steel, titanium, aluminum, K-monel, composite materials, and engineering plastics. Alternative materials for certain components such as the follower 201, pump tongue 802, magazine adapter 212, that may benefit from reduced friction include, but are not limited to, UHMW-PE, acetal polymers, NYLON 6, and Acrylonitrile Butadiene Styrene ("ABS"). Materials that may be suitable to form the pump 130 can include, but are not limited to, glass-filled nylon, ABS, other engineering plastics, steel, stainless steel, titanium, aluminum, metal alloys, and K-monel.

In further embodiments of the disclosure, certain components and mechanisms described herein may have structures or features that differ from the detailed embodiments described, while performing substantially the same functions. For example, the magazine track 200, the reserve magazines 210, and/or the magazine adapter 212 may have specific shapes that vary from the exemplary configurations described and illustrated herein, where such alternate shapes still facilitate motion of the reserve magazine 210 to move horizontally along the magazine track 200.

As a further example, the embodiment shown in FIG. 4A includes a magazine track 200 with a magazine track groove 217 provided on each of its inner lateral sides configured to receive the edge protrusions 215 of the magazine adapter 212, such that the reserve magazine 210 can be translated along the magazine track 200. Alternative embodiments of the magazine track 200 may provide the magazine track 200 as a protrusion or rail that can be received by corresponding structures or features on the magazine adapter 212, thereby also facilitating longitudinal movement of the magazine adapter 212 (and also the entire reserve magazine 210) along that rail. Grooves or recesses can also be provided on the magazine adapter 212 that are configured to engage the dowels 422 and 423 as described herein.

The features provided on the reserve magazine 210 that interact with the magazine track 200 may be provided as a separate magazine adapter 212, as described herein, where such adapter can be affixed or coupled to a conventional magazine 211. In further exemplary embodiments, the reserve magazine 210 can be provided as a custom or purposed component that is adapted for use with the magazine track 200 and other mechanisms as described herein. In a still further embodiment, the magazine adapter 212 may not surround a conventional magazine 211 as shown in FIG. 3, but it may instead be a component that can clip onto a conventional magazine 211 that includes just the edge protrusions 215 and a structure that contacts the active magazine well wall 142 to correctly position the reserve magazine 210 while it is moved upward into the active magazine well 141. Alternatively, the magazine adapter 212 may include just the edge protrusions 215 attached to the conventional magazine 211, where the shape and/or position of the active magazine well wall 142 can be configured to contact a portion of a conventional magazine 211 to correctly position it in the active magazine well 141.

The embodiment for the reloading process described herein above includes an exemplary pump 130, as shown in FIG. 1, that is configured to slide along a direction substantially parallel to the main axis of the lower receiver 120, e.g., first moving proximally towards the direction of the buttstock 102 and then distally back towards the muzzle 111, as described herein for the exemplary magazine reloading procedure. Alternative embodiments of the present disclosure may include, but are not limited to, protrusions or rails affixed to or formed as part of the lower receiver 120, with corresponding recesses or grooves provided in the pump 130 that are configured to receive such rails. Bearings can optionally be provided for any of the sliding components described herein to reduce resistance of the sliding movement and/or improve stability of the mechanism. Alternatively or additionally, low-friction materials known in the art can be used to form or coat portions of the components that are in contact to again reduce resistance of the sliding movement. In a further embodiment, the recesses or grooves may be attached to (or formed as part of) the lower receiver 120, and the rails attached to (or formed as part of) the pump 130. Still further embodiments may include different shapes of the pump 130, which may be selected based on aesthetics and/or functionality, e.g., to protect the stored reserve magazines 210, provide a good grip to facilitate the pump sliding motion during magazine reloading, etc.

The design and action of the exemplary lever arms 410, 411, 412, 413 may be provided in different configurations that result in one or more lever arms with structures adapted to engage a reserve magazine 210 and move it upward into the active magazine well 141 until it is held in place by an active magazine catch-and-release 144, similar to the procedure described herein and illustrated in FIGS. 7-11. Alternative embodiments of the mechanism for guiding a reserve magazine 210 from the magazine rack into the active magazine well 141 can include one or more lever arms having different lever arm shapes and/or sizes, different numbers of lever arms, different pivot points or pivot point designs, different configurations on each side of the magazine track 200, providing one or more lever arms on only one side of the magazine track 200 (instead of symmetrically on both sides as described herein), and lifting the reserve magazine 210 into the active magazine well 141 from the bottom instead of or in addition to the magazine adapter slots 216 on the sides. Alternate embodiments of the reserve magazine release trigger 424 may provide such trigger on a lever arm other than the third lever arm 412 and configured to provide an equivalent action.

In an exemplary embodiment described above, the lever arms 410, 411, 412, 413 are actuated by a horizontal movement of the pump 130 along the axis of the firearm. Alternative embodiments for actuating the one or more lever arms may include, but are not limited to, a configuration of springs that can store energy created by a user motion and are subsequently released, or a component configured to be grasped and moved laterally with respect to the AR-15 style firearm 101, which may then transfer the applied force to the one or more lever arms. For example, the component to be grasped and moved from the firearm may be provided as, e.g., a lever with a pivot on one end or a handle attached to a retractable cord or cable.

In further exemplary embodiments, a pin or mechanical catch can be provided to lock the pump 130 in place such that it is not susceptible to haphazard or accidental sliding movements when the AR-15 style firearm 101 is not being reloaded with a reserve magazine 210. In another alternative embodiment, the pump 130 may be held in place by a mechanism that releases the pump 130 for sliding when sufficient force is applied, but prevents the pump 130 from moving in response to unintentional bumps or movement of the lower receiver 120.

The magazine track 200, lever arms 410, 411, 412, 413, and reserve magazines 210 may optionally be encased by a protective covering in addition to being at least partially surrounded by the pump 130 or, e.g., where a pivoting lever is used instead of the pump 130. Such covering can protect the components from exposure to dirt moisture, debris, or the like, which may facilitate smooth and reliable operation of the various components and mechanisms as described herein.

The buttstock 102 is shown in FIG. 1 as a separate component at one end of the exemplary AR-15 style firearm 101 that can be attached to the lower receiver 120. In alternative embodiments, the buttstock 102 may be formed as a part of the lower receiver 120.

Alternative designs for the active magazine catch-and-release 144 and the part with the reserve magazine catch 502 and reserve magazine release lever 601 may also be used to accomplish the identical functions. The present embodiments are, therefore, to be considered as merely illustrative and not restrictive. In particular, a number of part shapes with the reserve magazine catch 502 and the reserve magazine release lever 601 may be designed to achieve the same function, including having multiple parts. The part with the reserve magazine catch 502 and reserve magazine release lever 601 may be on one side of the magazine track 200, on both sides or in another position to achieve the same functionality.

Alternative embodiments of the magazine track 200 may be designed. For example, the magazine track 200 may be constructed such that reserve magazines 210 are stored into either or both sides of the magazine track 200. Another embodiment may include specified slots within the magazine track 200 that correspond to the number of reserve magazines 210 the magazine track 200 is capable of storing. Alternatively, the magazines may be stored into the side of the magazine track 200, which has no specific slots and is a continuous unbroken track. Another embodiment may include an entire side of the magazine track 200 flipping down, or opening up such that the magazine track 200 can accommodate a plurality of magazines by storing the reserve magazines 210 into specified magazine slots and then closing the opening in the magazine track 200.

Further exemplary embodiments of the disclosure can include either permanent or interchangeable attachments provided within the magazine track 200 to which reserve magazines 210 may be attached or affixed such that the magazine track 200 need not be opened. For example, one or more magazine adapters 212 may be stored in the magazine track 200 as described herein, and then conventional magazines 211 or specially shaped ones may be inserted directly into the magazine adapters 212 from below to be stored. In this embodiment, the magazine adapters 212 and/or conventional magazines 211 can be configured such that the magazines 211 are reliably affixed to the stored magazine adapters 212 when inserted into them from below the magazine track 200.

In another alternative embodiment, the lower receiver 120 can be provided as two pieces, an upper unit and a lower unit. The upper unit can include attachment points configured to affix the upper unit to the upper receiver 110, the active magazine well 141, trigger components 122, pistol grip 121 and the attachment point for the buttstock 102 (or to the buttstock 102 itself). The lower unit can include the magazine track 200, follower 201, compression spring 202, pump—130, and the various components mechanically coupled to the pump 130. The upper and lower units may be rotatably coupled to each other by a pivot provided on their distal ends (e.g., the ends closest to the muzzle 111), and may be affixed to each other at their proximal ends (e.g. close to the active magazine well 141) by a catch or locking arrangement. To initially store reserve magazines in the firearm, the locking arrangement can be released to allow the proximal end of the lower unit to swing from the upper unit on the pivot, e.g., in a downward direction. The reserve magazines 210 may then be inserted into the magazine track 200 directly (instead of being slid in from the end of the magazine track 200 as described in other embodiments herein. The lower unit can then be pivoted upward back to its original position and locked to the upper unit, thereby securing the reserve magazines 210 in the magazine track 200. This embodiment avoids a positioning of each reserve magazine 210 in the active magazine well 141 to then slide it into the magazine track 200.

In yet another exemplary embodiment, a door or panel can be provided at the distal (muzzle) end of the magazine track 200. For example, the pump wall 501 can be configured as a removable component. Opening the panel can expose the distal end of the magazine track 200 and allows the compression spring 202 and follower 201 to be removed through the opening. The distal (muzzle) end of the compression spring 202 may be a separate component, or it may optionally be affixed to the panel. One or more reserve magazines 210 may then be inserted into the magazine track 200 from the distal end. The reserve magazine catch 502 can hold the first reserve magazine 210 inserted onto the magazine track 200 to prevent it from exiting the proximal end of the track and into the active magazine well 141. The follower 201 and compression spring 202 can then be reinserted into the magazine track 200, with the compression spring 202 being compressed against the stored reserve magazines 210, and the panel then closed or reattached to complete the storage procedure for the reserve magazines 210.

In still another embodiment, a removable panel (e.g., the pump wall 501 or the like) can be provided at the distal end of the magazine track 200, as described above. The follower 201 in the magazine track 200 can be moved into a fully retracted position within the magazine rack 200, compressing the compression spring 202, e.g., by manipulating a follower lever coupled to the follower 201. The follower lever can then be twisted or shifted to lock the compression spring 202 and follower 201 in place in the fully compressed position with a spring catch-and-release arrangement. The follower lever, compression spring 202 and follower 201 can optionally be affixed to the removable panel, and these components can be removed together to expose the distal end of the magazine track 200. One or more reserve magazines 210 can then be inserted into the magazine track 200 from the distal end, and held in the magazine track 200 by the reserve magazine catch 502. The panel with compression spring 202 and follower 201 can then be replaced at the distal end of the magazine track 200, and the compression spring 202 may then be released from the locked position so that the compression spring expands and the follower 201 exerts a force on the reserve magazines 210 towards the active magazine well 141.

In another embodiment of the disclosure, an exemplary firearm 1200 (shown in FIG. 12) can be provided that facilitates storage and semi-automatic or powered reloading of reserve magazines 210. The firearm 1200 can be provided with a magazine track 200 configured to store one or more reserve magazines 210, similar to the exemplary AR-15 style firearm 101 shown in FIGS. 1 and 2A-2B. Certain components of the exemplary firearm 1200 that are not explicitly shown or labeled in FIGS. 12-15 can generally correspond to similar features provided in the exemplary AR-15 style firearm 101 and illustrated in the preceding figures.

In operation, an active magazine 140 can be manually inserted into the active magazine well 141 and locked into place by the active magazine catch-and-release 144 (not labeled in FIG. 12), as described herein with respect to the AR-15 style firearm 101. This is similar to a magazine loading process for certain conventional firearms. When the active magazine 140 is exhausted of cartridges or replacement with a full magazine is desired, the active magazine release button 143 (not shown in FIG. 12) can be depressed or activated to release the active magazine catch-and-release 144 allowing the active magazine 140 to be manually pulled out of the active magazine well 141 or drop out of it due to gravity. A magazine reloading button (not shown), which may be located at any convenient location on the firearm 1200 (e.g., near the trigger, on the pistol grip 121, on the lower receiver 120, etc.) can then be activated to actuate an automated or powered mechanism that is adapted to move a reserve magazine 210 from storage inside the magazine track 200 to a locked position in the active magazine well 141.

Figure 12:
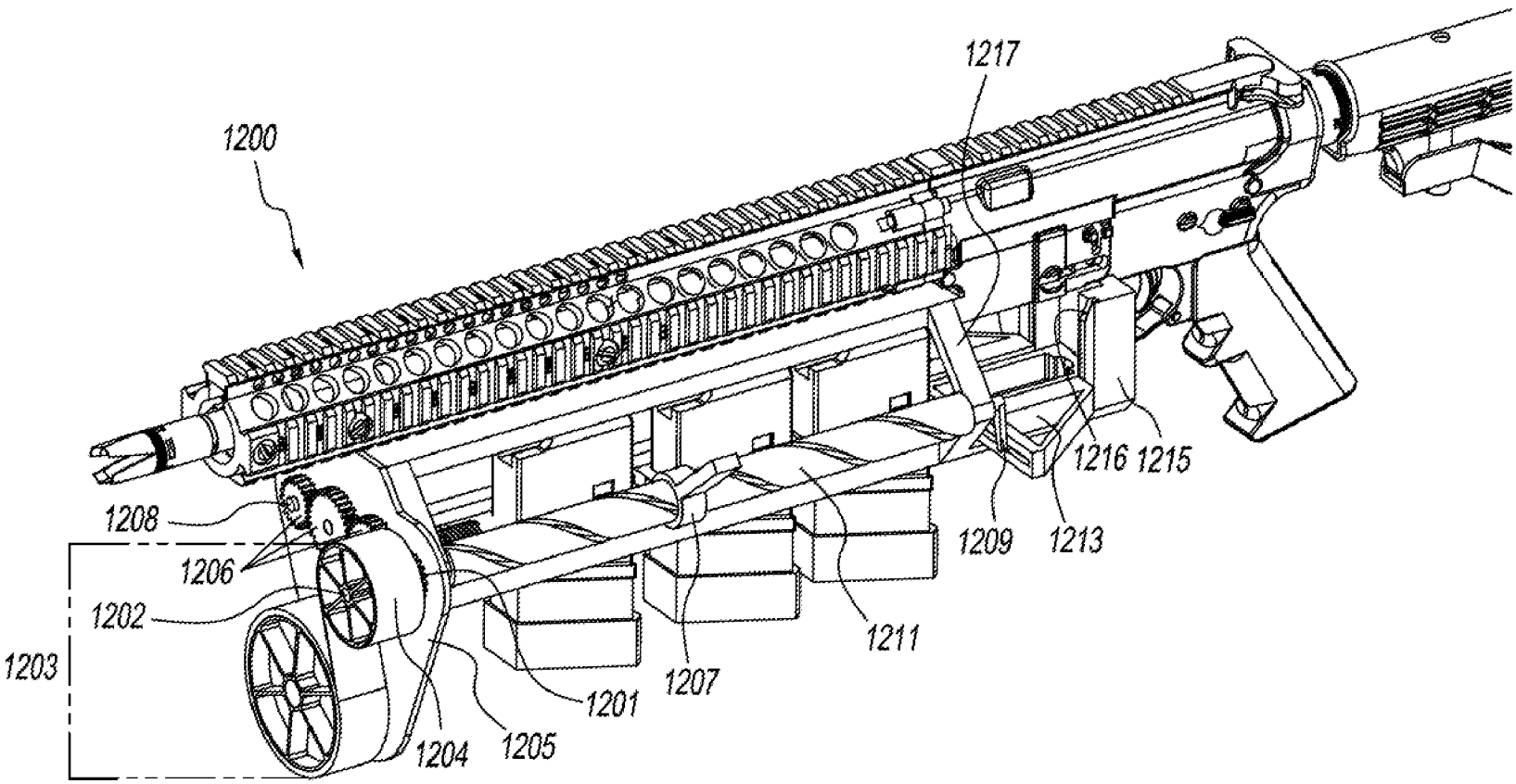
FIG. 12 is a perspective view of an exemplary firearm that includes an automatic exchange arrangement for reloading spare magazines in accordance with further embodiments of the present disclosure.

In one exemplary embodiment of the disclosure, a constant torque spring 1203 that includes two drums, as shown in FIG. 12, can be provided on the distal (muzzle) side of the magazine track end wall 1205. Such constant torque spring 1203 can be configured to provide a force to actuate certain mechanisms for reloading of a reserve magazine 210 into the active magazine well 141 of the firearm. The smaller drum 1204 of the constant torque spring 1203 can be affixed to a distal end of a primary drive shaft 1202 that passes through an opening in the magazine track end wall 1205 and extends in a direction substantially parallel to the main axis (e.g., the barrel axis) of the firearm 1200, such that the smaller drum 1204 and primary drive shaft 1202 rotate together. The proximal portion of the primary drive shaft 1202 (e.g., the end closer to the trigger and buttstock 102) passes through a drive shaft connection structure 1217 proximal to the active magazine well 141. The proximal end of the primary drive shaft 1202 can be coupled to a drive shaft force transmission lever 1209. The primary drive shaft 1202 is largely obscured in FIG. 12 because much of its length is surrounded by a helical gear 1211. A primary transmission gear 1201 can also be affixed to the primary drive shaft 1202 such that it can transfer a rotational force from the constant torque spring 1203 to one or more coupled secondary transmission gears 1206. For example, the exemplary configuration illustrated in FIG. 12 includes three secondary transmission gears 1206. One of the secondary transmission gears 1206 can be affixed to the secondary drive shaft 1208 such that they rotate together. This exemplary configuration facilitates a transfer of rotational forces from the constant torque spring 1203 to the primary drive shaft 1202 and the primary transmission gear 1201 affixed thereto, and from the primary transmission gear 1201 to the one or more secondary transmission gears 1206, and from one secondary transmission gear 1206 to the secondary drive shaft 1208.

The secondary drive shaft 1208 passes through an opening provided in the magazine track end wall 1205 and extends in a direction substantially parallel to the main axis of the firearm 1200, with the proximal portion of the secondary drive shaft 1208 also passing through the drive shaft connection structure 1217 and connecting to a further drive shaft force transmission lever 1209, similar to the primary drive shaft 1202. A helical gear 1211 can be provided around at least a portion of the primary drive shaft 1202 and attached to it such that they rotate together, as shown in FIG. 12. A charging handle 1207 that engages with the groove of the helical gear 1211 is configured such that when the charging handle 1207 is pushed in one direction, e.g., towards the distal (muzzle) end, it exerts a rotational force on the helical gear 1211 which rotates the primary drive shaft 1202, thereby turning the smaller drum 1204 of the constant torque spring 1203 to wind it up, increasing tension in the constant torque spring 1203. The charging handle 1207 can be constrained to travel along the length of the helical gear 1211 but not rotate around it, such that the charging handle 1207 is directed outward from the helical gear 1211 in a substantially constant direction as it moves longitudinally. As the constant torque spring 1203 is allowed to relax, the primary drive shaft 1202 rotates in the opposite direction, thereby rotating the helical gear 1211 and moving the charging handle 1207 back to its original position. In further embodiments, the charging handle 1207 can be configured to travel in the opposite direction, e.g., it can be pulled toward the buttstock end of the firearm 1200 to wind up the constant torque spring 1203, and then return back towards the distal/muzzle end when released in response to the unwinding or relaxing constant torque spring 1203.

Figure 13:
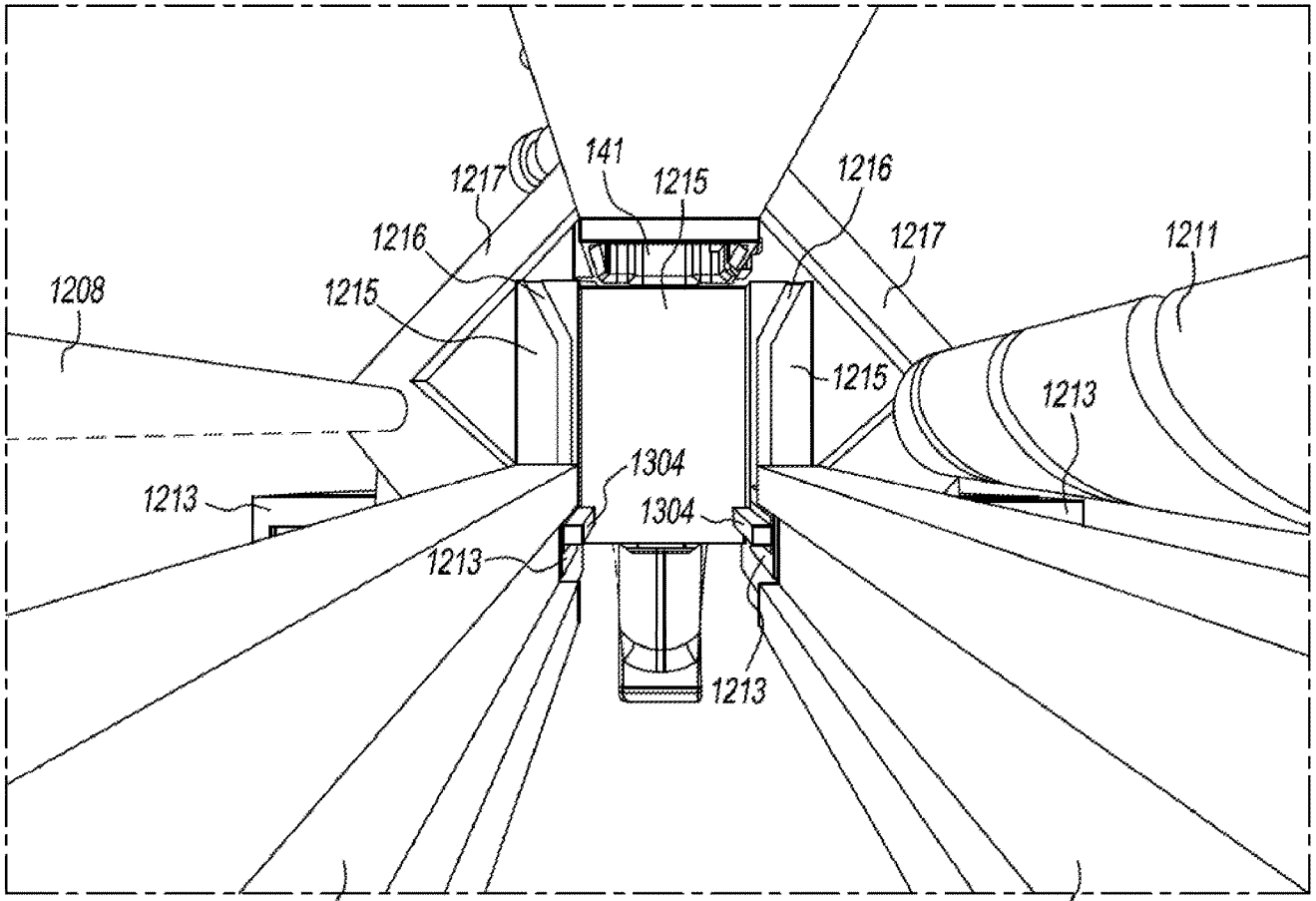
FIG. 13 is an end perspective view of the inside of the magazine track showing certain components of the exemplary automatic exchange arrangement illustrated in FIG. 12.

FIG. 13 is a view along the inside of the magazine track 200 of the firearm 1200 looking towards the proximal (buttstock) end. A magazine lift mechanism 1213 can be provided that is configured to move a reserve magazine 210 from underneath the active magazine well 141 up into the active magazine well 141 until it engages the active magazine catch-and-release 144, thereby securing the reserve magazine 210 in the active magazine well 141 to facilitate transfer of cartridges from the reserve magazine 210 into a firing chamber (not shown) to be fired by the firearm 1200. The exemplary magazine lift mechanism 1213 illustrated in FIGS. 12 and 13 can be constrained to move in a substantially vertical direction, e.g., along corresponding active magazine well wall track grooves 1216 provided in the active magazine well wall 1215. The magazine lift mechanism 1213 can be moved up and down by the drive shaft force transmission levers 1209. For example, the drive shaft force transmission levers 1209 can be provided with pins or the like that engage with a substantially horizontal slot provided in the magazine lift mechanism 1213, as shown in FIG. 12. As the drive shaft force transmission levers 1209 rotate (e.g., together with the primary and secondary drive shafts 1202, 1208 to which they are affixed), the pin on each drive shaft force transmission lever 1209 can rotate around the axis of the corresponding drive shaft 1202, 1208 while engaging the magazine lift mechanism 1213 through the slot therein, thereby lifting or lowering the magazine lift mechanism 1213, depending on the direction and amount of rotation.

The exemplary magazine lift mechanism 1213 as illustrated in FIG. 13 includes two lift protrusions 1304 that project into the central region of the magazine track 200 near the active magazine well 141. These lift protrusions 1304 may be configured to engage the magazine adapter slots 216 of a reserve magazine adapter 212 (shown in FIG. 3) on both sides when the magazine lift mechanism 1213 is in a downward position, e.g., lowered from the active magazine well 141. After the reserve magazine 210 with the magazine adapter 212 is released and pushed from the magazine track 200 toward the active magazine well 141 (e.g., in a manner similar to that described herein for the exemplary firearm shown in FIGS. 1, 7, 9A, 9B, and 10A-D), it may then slide onto the lift protrusions 1304 which position the reserve magazine 210 beneath the active magazine well 141 (not shown in FIG. 13).

Figure 14:
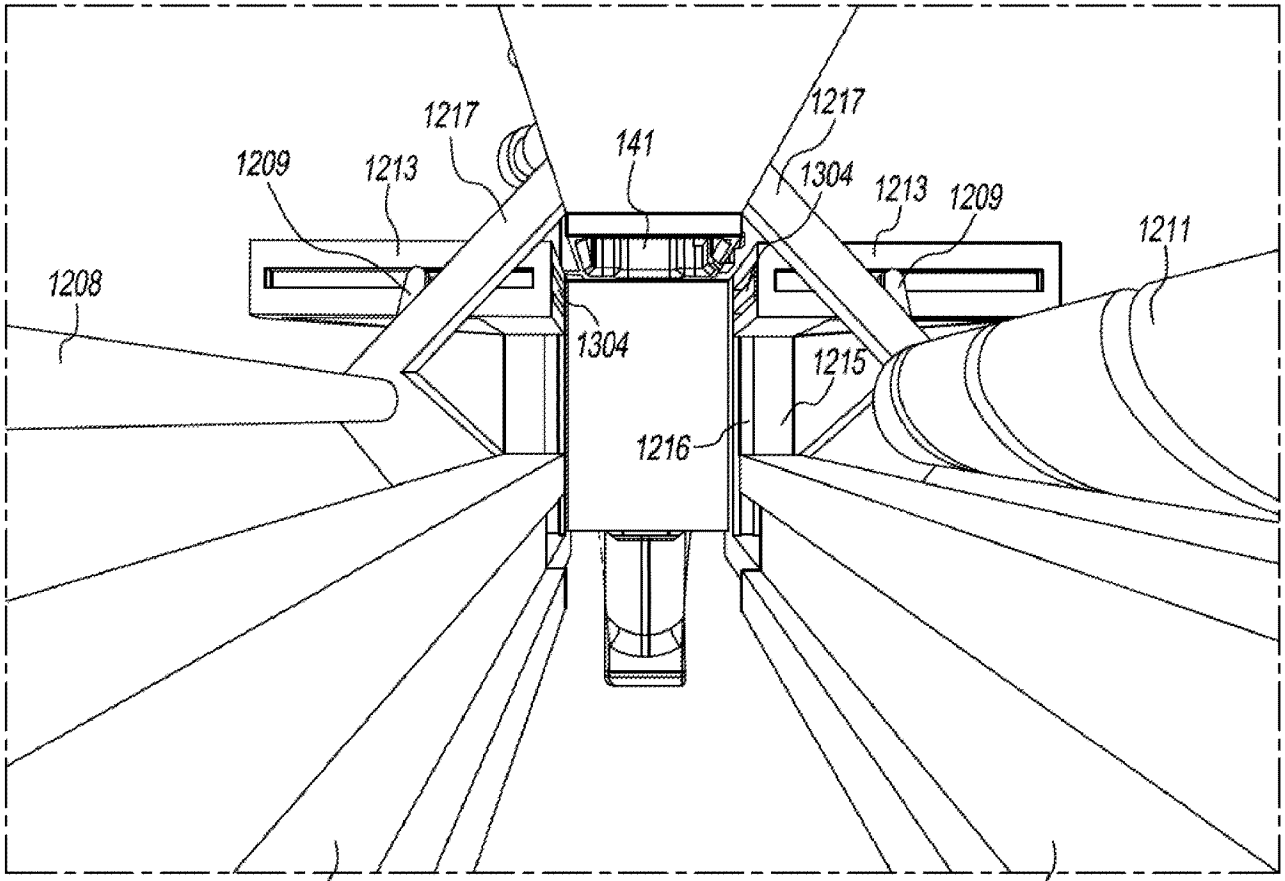
FIG. 14 is another end perspective view of the inside of the magazine track and portions of the exemplary automatic exchange arrangement illustrated in FIG. 13, where a magazine lift mechanism has risen and reloaded a reserve magazine (not shown) into the active magazine well.

As shown in FIG. 14, the magazine lift mechanism 1213 may then be pushed upward toward the active magazine well 141 (by the rotation of the drive shaft force transmission levers 1209) such that the reserve magazine 210 will engage the active magazine catch-and-release 144. (Reserve magazine 210 is not shown in FIG. 14) The upper portions of the active magazine well wall track grooves 1216 provided in the active magazine well wall 1215 can diverge outward (e.g. away from the central axis of the firearm 1200), as shown in FIGS. 12 and 13 such that the lift protrusions 1304 will move sideways and retract outwardly when the magazine lift mechanism 1213 is raised high enough in the active magazine well wall track grooves 1216. In this manner, the lift protrusions 1304 can disengage from the magazine adapter 212 after the reserve magazine 210 has been inserted into the active magazine well 141, engaged by the active magazine catch-and-release 144, and is ready to dispense cartridges into the firing chamber.

Figure 15:
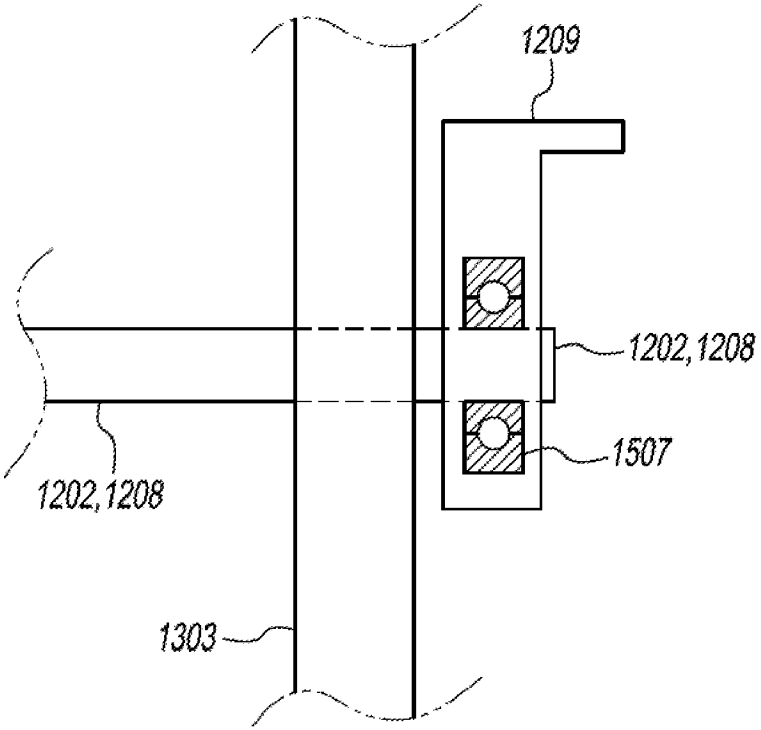
FIG. 15 is a side view of an exemplary ball bearing clutch that can be used with the automatic exchange arrangement illustrated in FIGS. 12-14.

As shown in FIG. 15, the drive shaft force transmission levers 1209 may be coupled to the drive shafts 1202 and 1208 via clutch arrangements, for example ball bearing clutches 1507 or the like. The clutch arrangements 1507 can be directional, for example, such that they prevent the drive shaft force transmission levers 1209 from rotating when the drive shafts 1202, 1208 rotate in the direction that charges or winds the constant torque spring 1203, e.g., during the initial movement direction of the charging handle 1207. This configuration can restrict the drive shaft force transmission levers 1209 to rotate only when the constant torque spring 1203 is releasing energy, e.g., when the charging handle is released. This rotation can result in the pins at the end of the drive shaft force transmission levers 1209 turning in a full circle around a horizontal axis as they slide along the slots provided in the magazine lift mechanism 1213, thereby translating the rotation of the drive shafts into a vertical movement that may be transferred to the magazine lift mechanism 1213.

One or more reserve magazines 210 can be stored in the magazine track 200 of the firearm 1200 in a manner similar to that described herein with respect to the exemplary AR-15 style firearm 101. For example, the firearm 1200 can also include a compression spring 202, a follower 201, and a reserve magazine catch 502 that can hold the reserve magazines 210 in the magazine track 200. Energy can be stored in the constant torque spring 1203 by moving the charging handle 1207 in a first direction, as described above. To reload a reserve magazine 210 that may contain additional cartridges to fire, the active magazine catch-and-release 144 can be activated (e.g., by pressing a button or moving a mechanical switch) to empty the active magazine well 141. The reloading of a reserve magazine 210 into the now-empty active magazine well 141 can then be performed as follows.

A first locking mechanism (not shown) holding the magazine lift mechanism 1213 in a raised position can be released, allowing the magazine lift mechanism 1213 to lower under the force provided by the constant torque spring 1203 via the drive shafts 1202, 1208 and drive shaft force transmission levers 1209 as described herein. When the magazine lift mechanism 1213 reaches a lowermost position, it may be held in place by a second locking mechanism (not shown). A mechanical coupling between the magazine lift mechanism 1213 and the reserve magazine catch 502 can release the reserve magazine catch 502 (e.g., as described with respect to the AR-15 style firearm 101 herein), thereby releasing a reserve magazine 210 that is then pushed under the active magazine well 141 by the compression spring 202 and follower 201, at which point it is held by the lift protrusions 1304.

When the magazine adapter 212 on the reserve magazine 210 is pushed against the active magazine well wall 1215, it can be configured to release the second locking mechanism (not shown). This allows the magazine lift mechanism 1213 to rise based on the spring-driven rotation of the drive shaft force transmission levers 1209, which raises the reserve magazine 210 into the active magazine well 141 where it can be secured in place by the active magazine catch-and-release 144 before the lift protrusions 1304 retract and release their hold on the magazine adapter 212. This reserve magazine 210 is now the active magazine 140, and it is in position to dispense cartridges into the firing chamber of the firearm 1200.

The exemplary firearm 1200 may include alternate configurations and/or specific components that may perform substantially the same actions. For example, the constant torque spring 1203 that rotates the drive shafts 1202, 1208 may be replaced with different types of energy storage devices, e.g., an electric motor (with associated power source), a pre-loaded spring arrangement that can retain sufficient potential energy to reload all reserve magazines 210 stored in the magazine track 200, or the like. Similarly, alternate components or configurations may be used to wind or otherwise store energy in the constant torque spring 1203 or motor instead of the exemplary helical gear 1211 and charging handle 1207 described herein.

In a further embodiment, the firearm 1200 may be configured such that the entire magazine reloading procedure may be automated and activated by a single button or lever. For example, conventional levers, catches, ratcheting mechanisms, or the like that are known in the mechanical arts can be used such that sequential motion of the various components described herein can mechanically initiate subsequent processes, including the various locking or releasing steps.

Still further embodiments of the present disclosure may include additional features, gadgets and/or accessories or different configurations of the magazine track 200. For example, the AR-15 style firearm 101, 1200 may be provided with a plurality of magazine tracks 200. Individual reserve magazine 210 may be joined to other accessories such as conventional coupled magazines, or other weapons or equipment.

In yet another exemplary embodiment, a circular magazine track 200 can be provided that can retain spent magazines in the magazine track 200. Such circular magazines that cannot leave the magazine track may be capable of being reloaded while still connected to the magazine track 200. The circular magazine track may be constructed to store fixed magazines.

The foregoing merely illustrates the principles of the present invention. Other variations to the disclosed embodiments can be understood and effected by those skilled in the art in practicing the claimed invention from a study of the drawings, the disclosure, and the appended claims. In the claims, the word "comprising" does not exclude other elements or steps and the indefinite article "a" or "an" does not exclude a plurality. The mere fact that certain measures are recited in mutually different dependent claims does not indicate that a combination of these measures cannot be used advantageously. Any reference signs in the claims should not be construed as limiting the scope of the claims. Various modifications and alterations to the described embodiments will be apparent to those skilled in the art in view of the teachings herein. It will thus be appreciated that those skilled in the art will be able to devise numerous techniques which, although not explicitly described herein, embody the principles of the present invention and are thus within the spirit and scope of the present invention. All references cited herein are incorporated herein by reference in their entireties.

What is claimed is:

1. A manually portable firearm for firing cartridges contained in a magazine positioned in a magazine well of said manually portable firearm, comprising:

a storage arrangement including a magazine track fixed to said manually portable firearm and receptive to at least one reserve magazine, said storage arrangement including a reserve magazine retainer; and a mechanical reloading arrangement with at least one lever arm coupled to a release trigger in selective engagement with said reserve magazine retainer, said at least one lever arm further including a protrusion guiding transportation of said at least one reserve magazine into alignment with said magazine well of said manually portable firearm upon said reserve magazine being released from said reserve magazine retainer, said at least one lever arm engaging said at least one reserve magazine in said magazine well after said magazine is removed from said magazine well.

2. The firearm of claim 1, wherein said storage arrangement includes a spring biasing the at least one reserve magazine toward said magazine well.

3. The manually portable firearm of claim 2, wherein said mechanical reloading arrangement includes a follower in sliding engagement with said magazine track and being in abutment with said spring.

4. The firearm of claim 1, wherein said mechanical reloading arrangement is configured to accept said at least one reserve magazine from said storage arrangement, and engage said at least one reserve magazine in said magazine well.

5. The firearm of claim 1, wherein said mechanical reloading arrangement is configured to be activated by at least one of a single button, or a single pump, or a single translating handle.

6. The manually portable firearm of claim 1, wherein said at least one reserve magazine includes an adapter defining a pair of opposed edge protrusions engageable with said magazine track.

7. The manually portable firearm of claim 1, wherein said at least one reserve magazine defines a pair of opposed edge protrusions engageable with the magazine track.

8. The manually portable firearm of claim 1, wherein each of said at least one lever arm includes a protrusion guiding said transportation of said at least one magazine into alignment with said magazine well of said manually portable firearm.

9. The manually portable firearm of claim 8, wherein a first group of said at least one lever arm is pivotally mounted to a first side of said manually portable firearm.

10. The manually portable firearm of claim 9, wherein a second group of said at least one lever arm is pivotally mounted to a second side of said manually portable firearm opposed to said first side.

11. A magazine reloading arrangement for a manually portable firearm, comprising:

a storage arrangement including a magazine track attachable to said manually portable firearm and receptive to at least one reserve magazine, the storage arrangement including a reserve magazine retainer; and a mechanical reloading arrangement with at least one lever arm coupled to a release trigger in selective engagement with said reserve magazine retainer, said at least one lever arm further including a protrusion guiding transportation of said at least one reserve magazine into alignment with a magazine well of said manually portable firearm upon said reserve magazine being released from said reserve magazine retainer, said at least one lever arm engaging said at least one reserve magazine in said magazine well when said mechanical reloading arrangement is affixed to said manually portable firearm.

12. The magazine reloading arrangement of claim 11, wherein said storage arrangement includes a spring biasing said at least one reserve magazine toward said magazine well.

13. The magazine reloading arrangement of claim 12, wherein said mechanical reloading arrangement includes a follower in sliding engagement with said magazine track and being in abutment with said spring.

14. The magazine reloading arrangement of claim 11, wherein said mechanical reloading arrangement is configured to accept said at least one reserve magazine from said storage arrangement, and engage said at least one reserve magazine in said magazine well.

15. The magazine reloading arrangement of claim 11, wherein at least one lever arm is configured to interact with a portion of said at least one reserve magazine to transport said at least one reserve magazine from said storage arrangement to said magazine well.

16. The magazine reloading arrangement of claim 11, wherein said mechanical reloading arrangement is configured to be activated by at least one of a single button, or a single pump, or a single translating handle.

17. The magazine reloading arrangement of claim 11, wherein said reserve magazine retainer releases a single reserve magazine when said reserve magazine retainer is disengaged from said release trigger.

18. The magazine reloading arrangement of claim 11, wherein said at least one reserve magazine includes an adapter defining a pair of opposed edge protrusions engageable with said magazine track.

19. The magazine reloading arrangement of claim 11, wherein said at least one reserve magazine defines a pair of opposed edge protrusions engageable with the magazine track.

20. The magazine reloading arrangement of claim 11, wherein said protrusion on said lever arm is a cylindrical dowel.

21. A method for reloading a manually portable firearm, comprising the steps of:

providing a storage arrangement including a magazine track configured to be affixed to said manually portable firearm and receptive to at least one reserve magazine, the storage arrangement including a reserve magazine retainer;

providing a mechanical reloading arrangement with at least one lever arm coupled to a release trigger in selective engagement with said reserve magazine retainer, said at least one lever arm further including a protrusion guiding transportation of said at least one reserve magazine into alignment with a magazine well of said manually portable firearm upon said reserve magazine being released from said reserve magazine retainer, said at least one lever arm engaging said at least one reserve magazine in said magazine well when said mechanical reloading arrangement is affixed to said manually portable firearm;

providing at least one reserve magazine in said storage arrangement; and activating said mechanical reloading arrangement.

22. The method of claim 21, further comprising the step of:

removing a magazine from said magazine well prior to activating said mechanical reloading arrangement.

23. The method of claim 21, wherein activating said mechanical reloading arrangement comprises at least one of pressing a button, moving a pump, or translating a handle associated with said mechanical reloading arrangement.

24. The magazine reloading arrangement of claim 21, wherein each of said at least one lever arm includes a protrusion guiding said transportation of said at least one magazine into alignment with said magazine well of said manually portable firearm.

25. The magazine reloading arrangement of claim 24, wherein a first group of said at least one lever arm is pivotally mounted to a first side of said manually portable firearm.

26. The magazine reloading arrangement of claim 25, wherein a second group of said at least one lever arm is pivotally mounted to a second side of said manually portable firearm opposed to said first side.

* * * * *